US009922487B2

(12) United States Patent
Blau

(10) Patent No.: US 9,922,487 B2
(45) Date of Patent: Mar. 20, 2018

(54) DEVICE FOR USE IN DETECTING COUNTERFEIT OR ALTERED BULLION, COINS OR METAL

(71) Applicant: Sigma Metalytics, LLC, Chico, CA (US)

(72) Inventor: Dave Blau, Chico, CA (US)

(73) Assignee: SIGMA METALYTICS, LLC, Chico, CA (US)

( * ) Notice: Subject to any disclaimer, the term of this patent is extended or adjusted under 35 U.S.C. 154(b) by 452 days.

(21) Appl. No.: 14/484,107

(22) Filed: Sep. 11, 2014

(65) Prior Publication Data

US 2015/0070035 A1 Mar. 12, 2015

Related U.S. Application Data

(60) Provisional application No. 61/876,561, filed on Sep. 11, 2013.

(51) Int. Cl.
*G07D 5/08* (2006.01)

(52) U.S. Cl.
CPC ..... *G07D 5/08* (2013.01)

(58) Field of Classification Search
None
See application file for complete search history.

(56) References Cited

U.S. PATENT DOCUMENTS 3,992,938 A 11/1976 Miller
4,226,323 A 10/1980 Dautremont
4,797,614 A 1/1989 Nelson
(Continued)

FOREIGN PATENT DOCUMENTS

CA 2479146 A1 3/2005
GB 2287341 A 9/1995
(Continued)

OTHER PUBLICATIONS

International Search Report and Written Opinion issued in PCT Application No. PCT/US2014/055239 dated Dec. 10, 2014.
(Continued)

*Primary Examiner* — Melissa Koval
*Assistant Examiner* — Felicia Farrow
(74) *Attorney, Agent, or Firm* — Venable LLP; Henry J. Daley; Laura G. Remus

(57) ABSTRACT

According to some embodiments of the present invention, a system for detecting counterfeit or altered coins or bullion includes a sensor system, an alternating current (AC) power supply electrically connected to the sensor system, a detection system electrically connected to the sensor system and the AC power supply, and a data processor configured to communicate with the detection system. The sensor system comprises an impedance component and a measurement circuit. The detection system is configured to determine a calibration complex impedance and a sample complex impedance. The data processor is configured to receive the calibration complex impedance and the sample complex impedance from the detection system, and provide information regarding a composition of the sample to distinguish valid coins and bullion from at least one of counterfeit or altered coins and bullion.

31 Claims, 20 Drawing Sheets

(56) References Cited

U.S. PATENT DOCUMENTS

| | | | | |
|---|---|---|---|---|
| 5,213,190 | A * | 5/1993 | Furneaux | G07D 5/08 194/317 |
| 5,525,903 | A | 6/1996 | Mandl et al. | |
| 5,552,704 | A | 9/1996 | Mallory et al. | |
| 7,584,833 | B2 | 9/2009 | Howells | |
| 2005/0051409 | A1 | 3/2005 | Howells | |
| 2006/0151284 | A1 | 7/2006 | Howells | |
| 2008/0230402 | A1 * | 9/2008 | Macor | G06Q 30/018 206/0.81 |
| 2009/0107800 | A1 | 4/2009 | Nishida et al. | |
| 2010/0261421 | A1 | 10/2010 | Wendell et al. | |
| 2013/0315437 | A1 * | 11/2013 | Kerschner | G06Q 30/018 702/82 |

FOREIGN PATENT DOCUMENTS

| | | | |
|---|---|---|---|
| JP | 2000-163621 | A | 6/2000 |
| KR | 1019890015176 | A | 10/1998 |
| WO | WO-93/21608 | A1 | 10/1993 |

OTHER PUBLICATIONS

"SigmaCheck Fully Featured Eddy Current Conductivity Meter," Retrieved from the Internet: URL: http://www.ethernde.com/instruments/conductivity-meters/sigmacheck (retrieved Mar. 28, 2017).

* cited by examiner

| Weight | Length | Width | Depth |
|---|---|---|---|
| 400 Ounce | 200 | 80 | 45 |
| 1 Kilo | 80 | 40 | 18 |
| 500 Grams | 65 | 32 | 14 |
| 250 Grams | 55 | 25 | 10 |
| 100 Grams | 55 | 31 | 3 |
| 50 Grams | 45 | 25 | 2.3 |
| 1 Ounce | 42 | 24 | 2 |
| 20 Grams | 39 | 22 | 1.3 |
| 10 Grams | 31 | 18 | 1 |
| 5 Grams | 23 | 14 | 0.7 |
| 1 Gram | 15 | 8 | 0.4 |

FIG. 14

DEVICE FOR USE IN DETECTING COUNTERFEIT OR ALTERED BULLION, COINS OR METAL

This application claims priority to U.S. Provisional Application No. 61/876,561 filed Sep. 11, 2013, the entire content of which is hereby incorporated by reference.

BACKGROUND

1. Technical Field

The field of the currently claimed embodiments of this invention relates to metal detection, and more particularly to detecting counterfeit or altered bullion, coins, or metal.

2. Discussion of Related Art

Coin and bullion investors and dealers need a means of quickly verifying the metal content of coins and bullion in a transactional environment. They need a device that allows for quick selection of a metal or alloy type, a straightforward way to place the coin or bullion on the measurement device, and a fast and concise display of the result.

XRF spectrometers come closest to meeting the above-described needs. XRFs cost about $20,000, are very slow to operate, and only measure the surface of the sample to a depth of about 100 millionths of an inch. They are easily fooled by plating and cladding. XRF devices have wear-out mechanisms that result in maintenance costs. They cannot be moved to coin shows or different locations, especially in public, because they are x-ray sources and need special permits to operate, with the permit specifying the location of operation. Also, they do not work well with coins because, during the manufacture of alloy coins, some of the metals are concentrated at the surface of the coin, so the XRF reading of the elements is not in correct proportion to the actual metal contained in the bulk of the coin.

Other methods that can be used to measure the metal in coins and bullion include chemical tests and specific gravity tests. Chemical tests are time consuming, expensive, and remove material from the coin or bullion under test. The removal of material affects the value of the sample, and thus methods such as chemical tests are never used on coins and bullion. Chemical tests are also typically messy and require replacement of the chemicals, and so are expensive. Additionally they take a long time to perform. Specific gravity measurements, an alternative to chemical tests, require complex placement of the coin or bullion into a chamber that is typically filled with water. The process is very time consuming and complex. Accordingly, neither of these methods is typically used in a transactional environment because they are slow, expensive, and possibly destructive.

For very large bullion, often a hole is drilled and a bolus of material is removed. The removed metal is then chemically tested, typically using atomic absorption, mass spectrometry, atomic emission, or another well-known method. The disadvantages of this method are that it is extremely expensive, time consuming, requires metal to be removed from the bullion, and only tests a very small fraction of the bullion.

Another method for testing large bullion is ultrasound. However, ultrasound does a poor job of determining metal type, and is primarily useful for detecting large inclusions in the bar. If the bar is a fairly consistent alloy, the ultrasound system must measure the speed of sound in the metal, which may be difficult due to variations in the thickness of the bar and the roughness of its surfaces. Securing a matching fluid to couple the ultrasound waves to the bar may also be difficult. Matching liquids need to be used to make the measurements which is very inconvenient.

A detection device is needed that is fast, portable, and non-destructive.

SUMMARY

According to some embodiments of the present invention, a system for detecting counterfeit or altered coins or bullion includes a sensor system, an alternating current (AC) power supply electrically connected to the sensor system, a detection system electrically connected to the sensor system and the AC power supply, and a data processor configured to communicate with the detection system. The sensor system comprises an impedance component and a measurement circuit, and the measurement circuit provides a measured value of at least one of voltage or current passing through the sensor system to the detection system. The AC power supply provides at least one of an alternating current or voltage to the sensor system and to the detection system. The detection system is configured to determine a calibration complex impedance based on the measured value of the at least one of voltage or current passing through the sensor system when no sample is in proximity of the impedance component, and based on at least one of the alternating current or voltage, respectively, provided by the power supply. The detection system is configured to determine a sample complex impedance based on the measured value of the at least one of voltage or current passing through the sensor system when the sample is in proximity of the impedance component, and based on at least one of the alternating current or voltage, respectively, provided by the power supply. The data processor is configured to receive the calibration complex impedance and the sample complex impedance from the detection system, and provide information regarding a composition of the sample based on the calibration complex impedance and the sample complex impedance to distinguish valid coins and bullion from at least one of counterfeit or altered coins and bullion.

According to some embodiments of the present invention, a system for detecting counterfeit or altered coins or bullion includes a detection system, a data processor in communication with the detection system, and a user interface in communication with the data processor. The user interface comprises an input device and a display device, and is configured to receive an indication of an expected composition of a sample from a user via the input device and communicate the indication to the data processor. The data processor is configured to receive measurement data from the detection system based on the indication, and determine information regarding a conductivity of the sample based on the received measurement data. The user interface is configured to receive an indication of the information and communicate the indication of the information to the user via the display device to distinguish valid coins and bullion from at least one of counterfeit or altered coins and bullion.

According to some embodiments of the present invention, a method for detecting counterfeit or altered coins or bullion includes receiving from a user an indication of an expected composition of a sample, and determining a first characteristic value and a frequency for measurement based on the indication. The method further includes performing a first measurement and a second measurement at the determined frequency, and determining a second characteristic value based on the first measurement and the second measurement. The method further includes displaying an indication of validity of the sample based on the first characteristic value and the second characteristic value.

BRIEF DESCRIPTION OF THE DRAWINGS

Further objectives and advantages will become apparent from a consideration of the description, drawings, and examples.

FIG. 14 shows dimensions for a variety of standard gold bars;

DETAILED DESCRIPTION

Some embodiments of the current invention are discussed in detail below. In describing embodiments, specific terminology is employed for the sake of clarity. However, the invention is not intended to be limited to the specific terminology so selected. A person skilled in the relevant art will recognize that other equivalent components can be employed and other methods developed without departing from the broad concepts of the current invention. All references cited anywhere in this specification, including the Background and Detailed Description sections, are incorporated by reference as if each had been individually incorporated.

Figure 1:
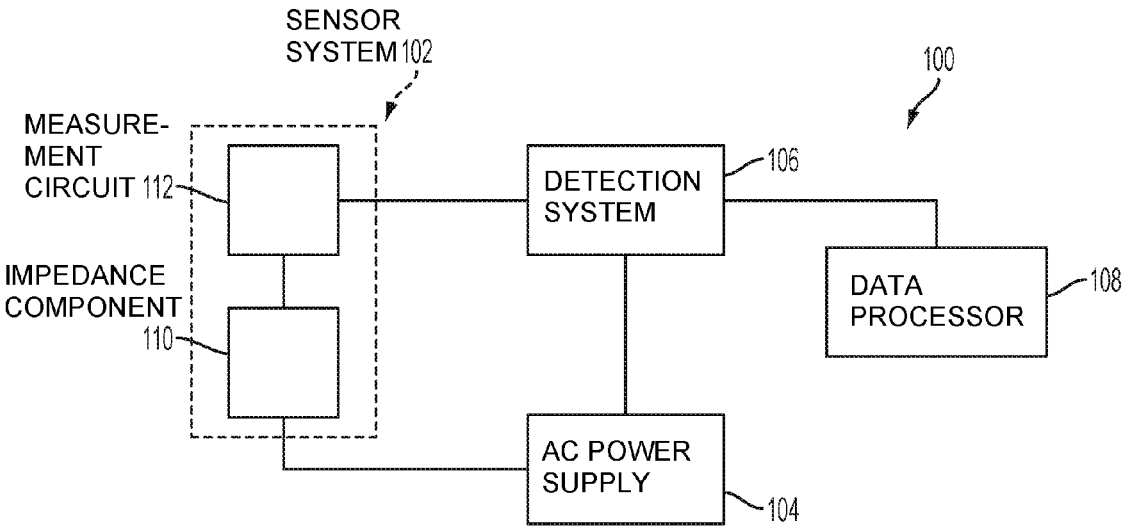
FIG. 1 is a schematic drawing of a detection device according to an embodiment of the present invention.

FIG. 1 is a schematic illustration of a system for detecting counterfeit or altered coins or bullion 100 according to an embodiment of the current invention. The system for detecting counterfeit or altered coins or bullion 100 includes a sensor system 102, an alternating current (AC) power supply 104 electrically connected to the sensor system 102, a detection system 106 electrically connected to the sensor system 102 and the AC power supply 104, and a data processor 108 configured to communicate with the detection system 106. The sensor system 102 may include an impedance component 110 and a measurement circuit 112.

In an embodiment of the invention, the detection system 106 may be a synchronous quadrature detector that is synchronous to the AC power supply 104. In some embodiments of the invention the detection system 106 is referred to as a detection component. The data processor 108 may be part of a computer system, for example. The computer system may be a localized computer such as a server, a workstation, a desktop computer, a laptop computer, a tablet or other hand-held device, or any other suitable data processor. The computer system could also be a multiprocessor system and/or a network of computers in some embodiments. The data processor 108 may be an integrated circuit such as, but not limited to, a field-programmable gate array (FPGA) or an application specific integrated circuit (ASIC), for example. The impedance component 110 may be a pot core, a flat coil, or any device that generates and is sensitive to changes in magnetic fields.

The measurement circuit 112 may provide a measured value of a voltage passing through the sensor system 102 to the detection system 106. The AC power supply 104 may provide an alternating current to the sensor system 102 and to the detection system 106. Alternatively, the measurement circuit 112 may provide a measured value of a current passing through the sensor system 102 to the detection system 106, and the AC power supply 104 may provide an alternating voltage to the sensor system 102 and to the detection system 106.

In an embodiment of the current invention, the detection system 106 is configured to determine a calibration complex impedance based on the measured value of the voltage or current passing through the sensor system 102 when no sample is in proximity of the impedance component 110, and based on the alternating current or voltage, respectively, provided by the AC power supply 104. In an embodiment, the detection system 106 then determines a sample complex impedance based on the measured value of the voltage or current passing through the sensor system 102 when a sample is in proximity of the impedance component 110, and based on at least one of the current or voltage, respectively, provided by the AC power supply 104.

The data processor 108 is configured to receive the calibration complex impedance and the sample complex impedance from the detection system 106, and provide information regarding a composition of the sample based on the calibration complex impedance and the sample complex impedance to distinguish valid coins and bullion from counterfeit or altered coins and bullion. The data processor 108 may also be configured to determine a calibration inductance and a calibration resistance based on the calibration complex impedance, as well as a sample inductance and a sample resistance based on the sample complex impedance. The data processor 108 may then determine the information regarding a composition of the sample based on the calibration inductance, calibration resistance, sample inductance, and sample resistance. The data processor 108 may determine the information regarding a composition of the sample based on a difference between the calibration inductance and the calibration resistance and based on a difference between the sample inductance and the sample resistance.

In some embodiments, the data processor 108 may provide information regarding a composition of the sample based on information stored in a look-up table. In some embodiments, the data processor 108 may also determine a displacement of the sample from the impedance component 110 based on the calibration complex impedance and the sample complex impedance. The data processor 108 may provide information regarding a composition of the sample based on the displacement. The impedance component 110 may include a target for aligning the sample.

Figure 2:
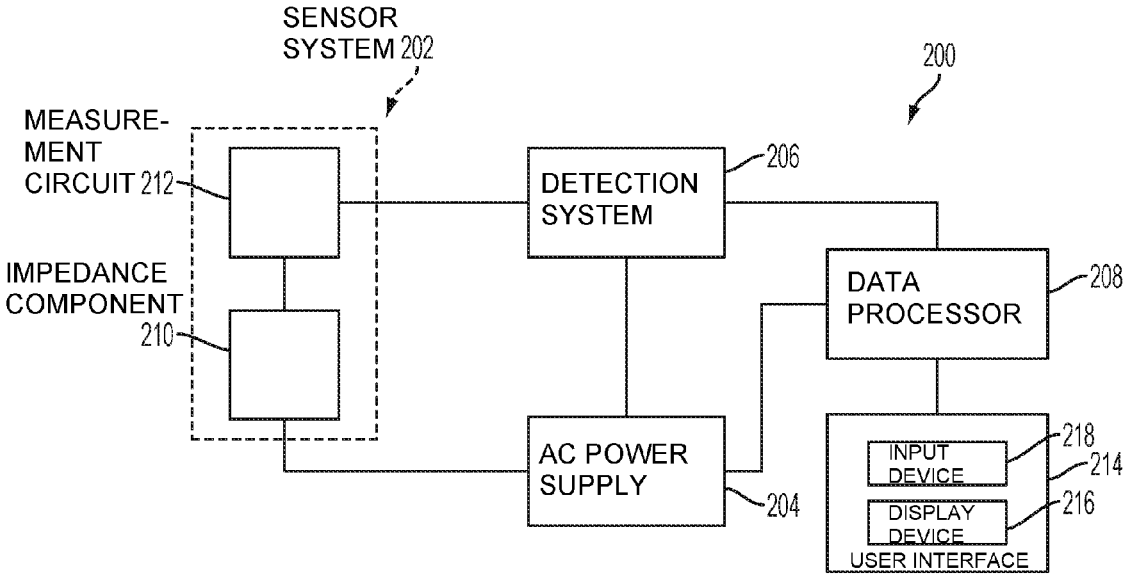
FIG. 2 is a schematic drawing of a detection device according to an additional embodiment of the present invention.

FIG. 2 shows a schematic illustration of a system for detecting counterfeit or altered coins or bullion 200 according to another embodiment of the invention. The system for detecting counterfeit or altered coins or bullion 200 includes a sensor system 202, an alternating current (AC) power supply 204 electrically connected to the sensor system 202, a detection system 206 electrically connected to the sensor system 202 and the AC power supply 204, and a data processor 208 configured to communicate with the detection system 206. The sensor system 202 may include an impedance component 210 and a measurement circuit 212. In some embodiments, the components 202, 204, 206, 208, 210, and 212 can be the same as or similar to the corresponding components 102, 104, 106, 108, 110 and 112 of the embodiment of FIG. 1. In addition to the elements shown in FIG. 1, the system 200 may include a user interface 214 in communication with the data processor 208. The user interface 214 may include an input device 216, such as a panel of buttons or a keyboard. The user interface 214 may receive from a user an indication of an expected composition of the sample. The user interface 214 may also include a display device 218, and may display an indication of the validity of the sample. The user interface 214 may communicate with the data processor 208 through hard-wired and/or wireless connections. Examples of the input device 216 and display device 218 according to embodiments of the invention are provided below.

A method for detecting counterfeit or altered coins or bullion according to an embodiment of the invention includes receiving from a user an indication of an expected composition of a sample, and determining a first characteristic value and a frequency for measurement based on the indication. The method further includes performing a first measurement and a second measurement at the determined frequency, and determining a second characteristic value based on the first measurement and the second measurement. The method further includes displaying an indication of validity of the sample based on the first characteristic value and the second characteristic value.

The following examples describe some embodiments in more detail. The broad concepts of the current invention are not intended to be limited to the particular examples.

EXAMPLES

In the following, the term "detection device" will also be used to refer to systems for detecting counterfeit or altered coins or bullion according to embodiments of the current invention.

The validity measurement may begin with a measurement of the calibration inductance $L_c$ and apparent resistance $R_c$ of the impedance component 210 with no sample. A sample may then be placed in proximity to the impedance component 210, and the sample inductance $L_s$ and resistance $R_s$ may be measured. To obtain effective resistances $R_c$ and $R_s$ and inductances $L_c$ and $L_s$, the applied voltage may be divided by the measured current. The voltage and current may each be complex numbers, so the impedance may have a real and an imaginary part. The real part is related to the resistance being measured, and the imaginary part is related to the inductance being measured. The inductive component is actually proportional to wL where w is the angular frequency of the AC power supply 204, so typically the angular frequency is divided out during the calculations. A value that is approximately proportional to the square root of the conductance of the sample is obtained by calculating $Q=(L_c-L_s)/(R_c-R_s)$. The distance from the impedance component 210 to the sample, also known as "liftoff," may be calculated from $k=1-L_s/L_c$. Unlike many of the prior-art methods and devices, the detection device described herein is not particularly sensitive to lift-off. Small measurement corrections may be made based on liftoff, typically on the order of a few percent of the conductivity. In an alternative embodiment in which an AC current is applied and a voltage is measured, the same result may be achieved by dividing the measured voltage by the applied current.

The AC power supply 204 may be made in a number of ways. Quadrature square waves may be generated with a conventional logic circuit, and then the square waves may be filtered to generate a pure sine wave output. The unfiltered square wave signals may be used by the detection system 206 as a timing signal. Another way to implement the AC power supply 204 is with a high speed digital-to-analogue converter (DAC) and a sine lookup table driving the DAC. The output of the sine wave may be very lightly filtered and used to drive the sensor system 202. The update rate of the DAC is typically 10 to 100 times the desired sine wave frequency. Two DACs may be used in the AC power supply 204 to make both sine and cosine waves at the test frequency. Any method of generating a sine wave for the excitation of sensor system 202 that also generates quadrature signals, either digital or analog, may be used for AC power supply 204. The sine wave generated by the AC power supply 204 may have harmonic content that is 60 dB or more below the fundamental. In an embodiment of the invention the data processor 208 may be in communication with the AC power supply 204, and may generate a quadrature square wave and use analog filters to make the sine wave.

The real and imaginary parts of the impedance may be measured by the detection system 206, which is typically a synchronous detector. For example, the detection system 206 may multiply the raw current signal (which is a sinusoid) by Sin(w t) for one channel and Cos(w t) for another channel (where w is the angular frequency of the AC power supply 204). This type of system is well known in the art as a quadrature detector, with one channel giving the real component of the current and the other giving the imaginary component of the current. Alternatively, the detection system 206 may be implemented by switches which switch the signal at the same rate as the AC power supply 204's sine wave, one channel synchronous with the zero crossings in the sine wave and one channel 90 degrees out of phase with the AC power supply 204 sine wave, thereby generating another type of quadrature detector. Alternatively, a fast A/D converter may be used, running at about 200 times the AC power supply 204's frequency, and the numeric values may go into multipliers that multiply the digitized the current signal by sine and cosine stored shapes synchronous with the AC power supply 204, thus implementing the detection system 206 completely in digital hardware. These examples are non-limiting, and any type of detection system that can detect the real and imaginary parts of the impedance may be used.

Once the currents are measured, the effective real and imaginary parts of the impedance seen at impedance component 210 are calculated. These two measurements are represented as L and R because they are effectively the apparent inductance and resistance of the impedance component 210. The ratios of L and R may be used to find numbers referred to herein as Q and k. Q is slightly different than the conventional understanding of Q of a coil because it is a relative Q, as described below. k is the conventional symbol used for the coupling coefficient in a transformer, and is actually the k of the effective transformer formed by the sensor coil and the sample. $L_c$ represents the imaginary impedance of the impedance component 210 taken without a sample in place, and $L_s$ represents the imaginary impedance when a sample is in the proximity of the impedance component 210. $R_c$ is the real part of the impedance of the impedance component 210 when no sample is in place, and $R_s$, is the real part of the impedance of the impedance component 210 when a sample is present. Q is defined as $Q=(L_c-L_s)/(R_c-R_s)$, and k is defined as $k=1-L_s/L_c$.

Before use, typically when the detection device 200 is turned on, the inductance and resistance of the impedance component 210 is measured with no sample in place. The calibration measurements give numbers $L_c$ and $R_c$, which are used later in the determination of the sample conductivity. In some embodiments, AC power supply 204 generates an AC voltage of about 1000 to 100,000 Hz that passes through the impedance component 210. First the data processor 208 determines the inductance and resistance of the impedance component 210 without a sample in place. The measurement circuit 212 determines the current amplitude and phase at the frequency generated, 100 kHz for smaller samples such as coins, and 1 kHz for larger samples such as bullion bars have been found to be suitable in some embodiments. This data is used by the detection system 206 and the data processor 208 to calculate $L_c$ and $R_c$.

Once $L_c$ and $R_c$ are measured, the user may enter the expected material using the input device 216, and may place the coin or bullion to be tested in the proximity of the impedance component 210. The typical distance from the impedance component 210 to the sample may be in the range of 0 to 0.25 inches for a 1-inch impedance component 210, larger for a larger diameter impedance component 210, and smaller for smaller diameter impedance component 210. Samples may be housed in cases or holders that are sealed, preventing the sample from being positioned close to the sensor. Therefore, it can be useful to be able to perform measurements with a moderate distance separating the impedance component 210 from the sample for some applications. The reading of the sample's validity is substantially the same no matter what the distance is between the sample under test and the impedance component 210, and also is not affected by nonconductive holders or cases for the sample as long as the distance between the impedance component 210 and the sample is not too great. The user interface 214 may have a target of some kind to show approximately where the user may place the sample, and how big the sample may be to cover the impedance component 210. The sample may have an area substantially covering the area of the face of the impedance component 210, such that closed eddy currents may cover the face of the impedance component 210. For smaller samples, a smaller impedance component 210 may be employed. The sample may be positioned such that the flat face of the sample is roughly parallel to the open face of the impedance component 210. Small angles between the sample face and the face of the impedance component 210 make very little difference to the measurement up to a 10 or 20 degree angle, so the angular placement of the sample is not critical.

Once the sample is in place, the measurement of $L_s$ and $R_s$ may be made, and the values of Q and k may be calculated. The AC power supply 204 may generate an AC voltage of about 1,000 to 100,000 Hz which passes through the impedance component 210. In some embodiments, one frequency is sufficient to determine the conductivity of the sample in the field of the impedance component 210. The measurement circuit 212 determines the amplitude and phase of the current or voltage at the frequency generated; for example, 100 kHz for smaller samples such as coins, and 1 kHz for larger samples such as bullion bars. Higher or lower frequencies may be used for thicker or thinner coins or bullion; lower frequencies can be used for thicker samples. The detection system 206 may detect the current or voltage values after the sample is placed, and the data processor 208 may calculate how much the inductance $L_s$ and resistance $R_s$ of the impedance component 210 changed when the sample was placed near the impedance component 210. Then Q is calculated as $(L_c-L_s)/(R_c-R_s)$, which gives a unique value related to the conductivity, and therefore the composition, of the coin or bullion. The data processor 208 may use stored expected values to determine the best match of the measurements against standards that were pre-stored in data processor 208, or else may display the value of the sample conductivity. The user interface 214 may indicate to the user if the Q of the coin or bullion under test matches the expected Q of the material entered by the user. In some embodiments, the match between prestored values in the data processor 208 and measured values from different samples is to within 2-3%, so 10% changes in conductivity of the sample are easy to measure. The measurement changes very little with coin stamping, sample flatness, wear on the coin, surface patina, sample angle, or distance from the impedance component 210 to the sample.

Typical conductivities of coin and bullion metals are shown in Table 1.

TABLE 1

| Metal | Conductivity (μohm cm) |
|---|---|
| Silver | 1.58 |
| Gold | 2.25 |
| 90% silver 10% copper | 1.90 |
| US coin metal | |
| Copper | 1.73 |
| Platinum | 10.5 |
| Palladium | 10.6 |

Some of the metals that may be used to alter the coin or bullion have the conductivities shown in Table 2.

TABLE 2

| Metal | Conductivity (μohm cm) |
|---|---|
| Lead | 14.5 |
| Tungsten | 5.6 |

Generally, the range of conductance for precious metals is about an order of magnitude, whereas the measurement method according to some embodiments can measure to within about 2% accuracy. This can allow very accurate matching between the expected Q for a metal sample as stored in the data processor 208 to the unknown sample.

The impedance component 210 generates magnetic fields which penetrate into the material under test. Depending on the conductivity of the metal under test, eddy currents may be generated. The eddy currents may modify the shape and strength of the magnetic field in the impedance component 210, and thereby change the readings of voltage or current made by the measurement circuit 212. The impedance component 210 is thus both an excitation device and the detector. The modifications to the inductance of the impedance component 210, embodied by the calculation $L_c-L_s$, and the change the apparent resistance of the impedance component 210, embodied by the calculation $R_c-R_s$, are both proportional to the distance from the sample to the impedance component 210. The ratio $(L_c-L_s)/(R_c-R_s)$, however, is virtually unaffected by the distance to the sample, and only depends on the sample's specific conductivity.

Figure 3:
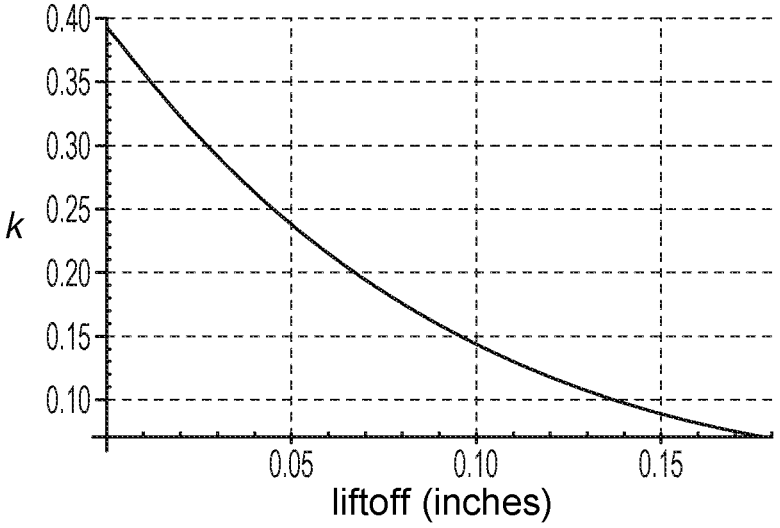
FIG. 3 shows how k depends on the distance from the sample to the impedance component.
Figure 4:
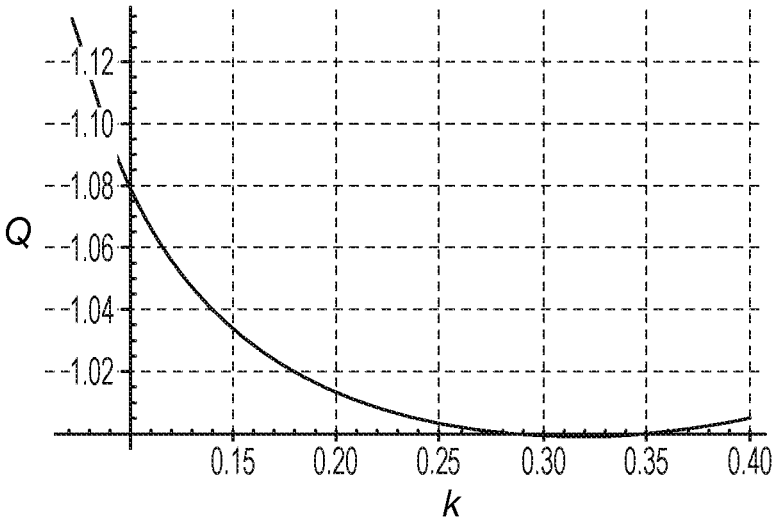
FIG. 4 shows the relationship between Q and k.

Although Q is nearly independent of the liftoff, the distance between the impedance component 210 and the sample may be calculated from the value of k. Typically if the sample is very close to the sensor, k=0.4, and when k<0.05 or so, the sample is too far away to read with consistency. FIG. 3 shows the relationship between k and liftoff, with liftoff in inches on the x-axis and k on the y-axis. Since the curve is monotonic, the liftoff distance can be determined by measuring k. FIG. 4 shows the relationship between normalized Q and k, with k on the x-axis and Q on the y-axis. The normalized Q is Q as it varies with k divided by the nominal Q of the sample at approximately k=0.25. Q is almost independent of liftoff and k, changing by only 12% over the entire range of liftoff. The effect of liftoff can be compensated for by multiplying Q by a small correction factor based on k.

Figure 5:
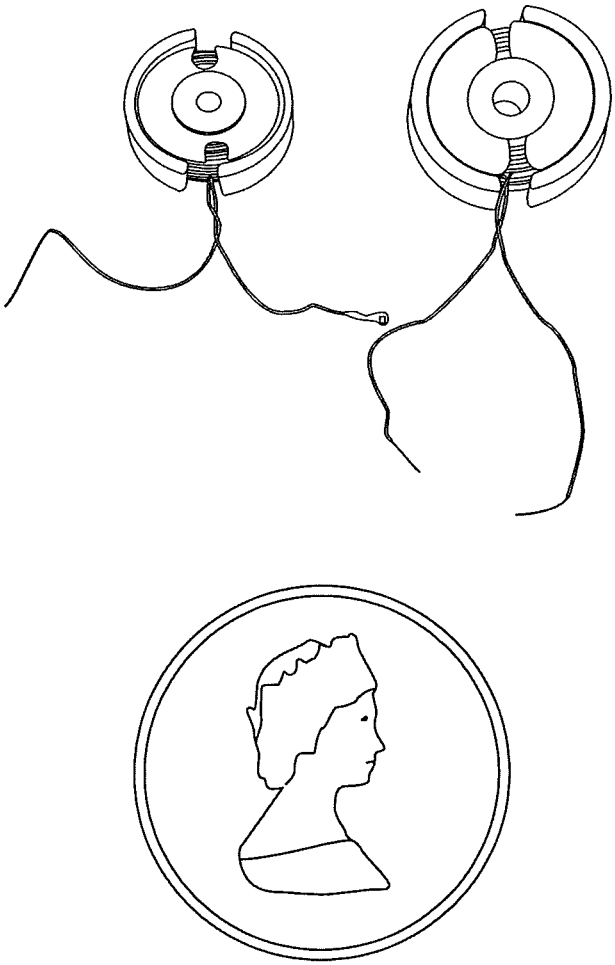
FIG. 5 shows example coils that may be used in the impedance component.
Figure 6:
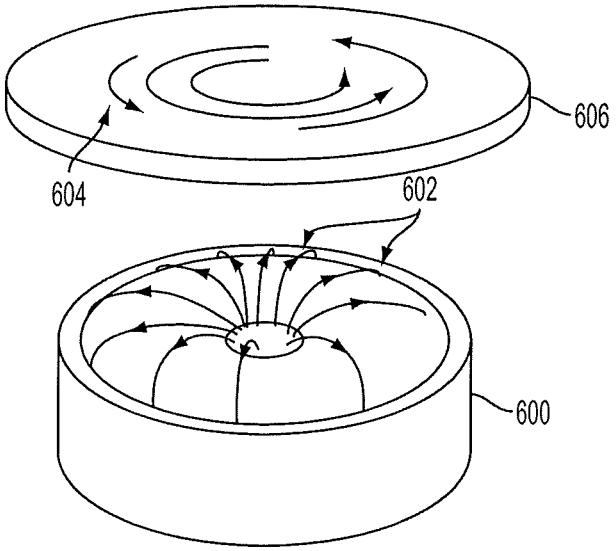
FIG. 6 illustrates magnetic field lines generated by the impedance component, and an induced current in a sample.

The impedance component 210 may be a pot core or flat coil, so that the fields generated by it are radial in nature. Example coils are shown in FIG. 5, and example field lines generated by the coils are shown in FIG. 6. FIG. 6 shows a pot core 600 generating radial magnetic field lines 602. The radial magnetic field 602 generates circular circulating currents 604 in the sample 606. The fields may be confined to a specific area of the sample so the measured area of the sample is approximately the size of the impedance component 210 and does not extend far outside the perimeter of the impedance component 210, since this area would increase in size as the sample is moved away, changing the measured region. This effect is minimized by using a pot core or a flat spiral coil for the impedance component 210.

Stored conductivity values in the data processor 208 may be converted to Q readings, or vice versa, so the stored conductivity values may be compared to the sample under test. The conversion between conductivity and Q is an equation of the form conductivity=(a constant related to the sensor size and frequency)×Q^2. In the data processor 208, the following may be stored: the metal name, the conductivity at a standard temperature, the temperature coefficient of conductivity, and the allowable tolerance. Not all of these values may be necessary, and other information may be useful as described below, such as coin thickness, weight, diameter, etc. However, in terms of the measurement of Q and k, the first four values may be used for the calculation of the sample conductivity. The conductivities of pure metals are well known and stable, but alloys can vary somewhat in composition. Alloy coins or bullion may require a slightly wider tolerance of conductivity than pure metals.

For each impedance component 210 and each frequency for which the impedance component 210 is used, the constant relating the conductivity to the Q reading may be stored in the data processor 208.

The frequency used may be high enough so the currents do not significantly penetrate through the sample. For example, the sample may be at least two skin depths thick at the frequency used if the sample thickness is not to influence the conductivity reading. The skin depth for metals may be calculated as approximately 0.517×sqrt[1/conductivity], where the conductivity is measured in MS/cm, and the skin depth is measured in millimeters. As an example, the skin depth for silver at 10 kHz is 0.64 mm. To measure the conductivity of a sample at 10 kHz with the method described and not have the sample thickness affect the conductivity reading significantly, a sample of silver may be about 1.3 mm thick.

Measurement of the coin or bullion thickness is possible with the impedance component 210. At low frequencies the impedance component 210's inductance and Q may be affected in different ways that allow determination of both thickness and conductivity using calculations and stored pre-measured values from known samples. However, if thickness information is not needed, a single frequency may be used that is high enough to not significantly penetrate all the way through the sample. The single frequency may be no lower than that which has a skin depth of about ½ to ¼ the expected sample thickness if the thickness information is not desired and only conductivity is to be measured. Typically, the Q measures conductivity and the k measures the distance to the sample from the impedance component 210 at these frequencies. At low frequencies, the sample thickness may become part of the measurement. By using multiple frequencies both the sample thickness and the conductivity may be obtained.

If only one frequency is used to obtain the conductivity of the sample, the frequency that is used may depend on the sample thickness and conductivity. For less conductive samples, higher frequencies may be used to maintain a consistent penetration into the samples compared to higher conductivity samples. If thinner samples are measured, the frequency may be changed to ensure that the fields do not penetrate the sample. Coins and bullion that are large in diameter or size are almost always thicker. For larger coin and bullion samples, a larger impedance component 210 may be used and may be run at lower frequencies. For example, the impedance component may comprise a coil having a larger diameter. For smaller coin and bullion, a smaller impedance component 210 and higher frequencies may be used. If the expected material of a sample is lower in conductivity, a higher frequency may be used to measure it.

Although any given sample may only require one frequency of measurement, multiple frequencies may be used to penetrate the correct distance into the sample, without penetrating too far. For example, when measuring 1 oz.

silver or gold coins, which are very conductive, a frequency of 40 kHz may be used. When measuring 1 oz. coins made of crown gold or platinum, which have much lower conductivities, a frequency of 100 kHz or even 200 kHz may be used. The AC power supply 204 may generate multiple frequencies to allow measurements on different sample thicknesses and materials. The frequency range used in typical small coins and bullion may be 1 kHz to 200 kHz. The user may select the sample metal or alloy, so the expected conductance of the expected alloy may be known. The data processor 208 may select the frequency to be used based on the selected metal or alloy, with higher frequencies used for less conductive sample and lower frequencies used for more conductive samples. The data processor 208 may instruct the AC power supply 204 to generate a current or voltage with the selected frequency.

Multiple impedance components 210 may useful to measure different sized samples. The different size impedance components 210 may be switched into the measuring circuit using typical analog switches, so that only one impedance component 210 is excited at a time. The impedance components 210 may not be larger than the sample to ensure that the measurements are accurate.

Sine waves may be used for excitation in the impedance components 210, and frequency data points may be collected sequentially if more than one frequency is used. However, in an embodiment of the invention, the AC power supply 204 may generate a series of pulses, and the measurement circuit 212 may take data through these pulses and between these pulses. Using Fourier transforms the pulse data may be converted to frequency data. The result, which includes values of frequency, inductance, and Q, may be the same in both cases. The data taken from an unknown coin or bullion may then be matched against a table that is pre-stored in the data processor 208 using conventional curve or data comparison methods including, but not limited to, least squares, Levenberg-Marquardt, interpolation, and extrapolation methods. A single answer indicating whether the coin or bullion under test is the expected material may be generated based on the various qualities of the fits. The data processor 208 may perform the calculation and determination of validity.

If multiple frequencies are used, least squares methods, curve fitting, or other methods may be employed to generate a single number or indicator representing the quality of the match between the unknown material under test and the pre-stored data sets. In this way, the stored values may be used to determine if the material under test is sufficiently close to match the stored standard values, and the low frequency data points may be used to determine the sample thickness. If the sample conductivity is sufficiently close, the coin or bullion under test may be taken as legitimate, and the user interface 214 may indicate that the coin or bullion is legitimate. If the values from the sample are not sufficiently close to the standard, pre-stored values, the coin or bullion under test may be taken as bogus, and this may be indicated by the user interface 214. Typically the values for Q at a single frequency will be within 1%.

The values of $L_c$ and $L_s$ may be used to determine if a sample is present. If no sample is present, $L_s=L_c$. As a sample is brought within the field of the impedance component 210, $L_s$ will begin to decrease ($L_c$ may be stored in the unit in advance of the sample measurement). At some value of $k=1-L_s/L_c$, the signal from the sample may be sufficiently large to get a valid measurement. Typically a value of k=0.05 is sufficient for an accurate measurement of the sample conductivity. If the detection device 200 is continuously measuring the impedance component 210, and it detects a sufficiently large change in k, the detection device 200 may automatically begin reading the conductivity of the sample and may give a reading of conductivity to the user. Using this sample detection method, the measurement may be very quick since no buttons need to be pressed to begin a sample measurement.

The impedance component 210 may be made with an open field, where the impedance component 210 has a gap into which the coin or bullion under test is inserted (see FIGS. 5 and 6). The coil may be half of a ferrite pot core and the coin or bullion may be placed on the open side of the core. The core may also be a nanocrystalline material, or even silicon steel laminate. The core may shape the fields penetrating the coin or bullion so that closed eddy current circulation may occur in the sample. The AC power supply 204 may consist of a simple conventional op-amp circuit that drives the impedance component 210. The data processor 208 may generate a series of numbers that are D/A converted into the waveform that is fed to the AC power supply 204. The detection system 206 may be a conventional phase sensitive quadrature detector, which generates DC voltages that are proportional to the currents at two quadrature phases. These DC voltages may then be converted to numbers in an A/D converter, and the numbers may be read by the data processor 208. These numbers may be used to generate the data previously described. There are many ways of shaping the field so that the coin or bullion alters the magnitude and shape of the field, including having coils on both sides of the coin or bullion under test. If impedance components 210 are placed on both sides of the sample, then two measurements may be made, one on each side, to effectively check the entire bulk of the sample.

In an embodiment of the invention, a bridge circuit may be used in such a way as to compare two coins or bullion that are supposed to be the same, and the equality of the measurements may determine the authenticity of the samples. If the samples behave differently, then one of them may be determined to be bogus. However, a bridge may be more complex to use than a single measurement against pre-stored known authentic samples. Multiple impedance components 210 may be used to measure larger samples all at one time, and an impedance component 210 can be added which separates the generation of the magnetic field from the detection of the field. Larger impedance components 210 may be used for thicker and larger coins or bullion, and multiple impedance components 210 may be used on the same device such that each impedance components 210 is set up to optimally measure one kind of coin or bullion.

A PC or other conventional computer may act as a data processor, an entry device, and a display, and may communicate with the electronics required to generate and measure the fields. For example, the sensor and the required circuits and the target for the sample could be contained in a small housing connected to a host computer by a digital interface, either wired or wireless. The program that analyzes the raw data could exist remotely in a computing "cloud" and the result could be sent back to the host computer.

The detection device may be connected to a computer or a cell phone with a wireless interface such as Bluetooth or Wi-Fi. The measurement may be automatically logged in an external record of the transaction, and the operator may not see the actual results. The results may be posted for use by a store, a bank, or a repository. The detection device may be miniaturized to the point that the device could be kept in a pocket and operated with a cell phone.

Figure 7:
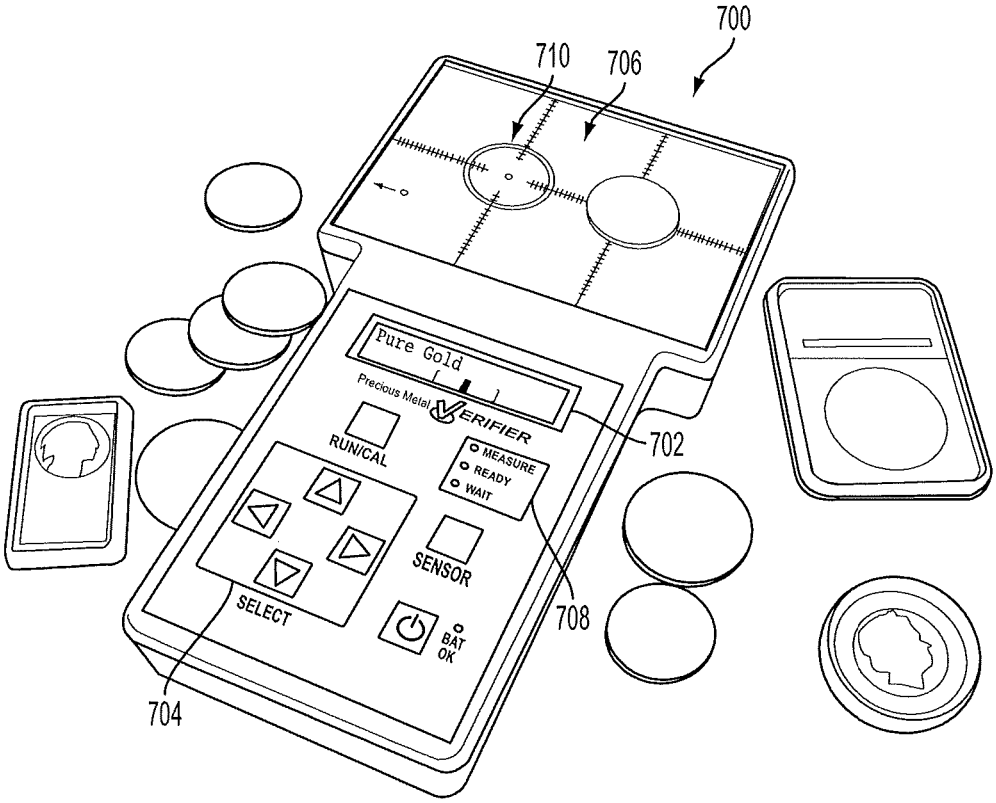
FIG. 7 shows a stand-alone detection device according to an embodiment of the invention.

According to another embodiment of the invention, a system for detecting counterfeit or altered coins or bullion includes a detection system, a data processor in communication with the detection system, and a user interface in communication with the data processor. FIG. 7 shows the system 700 for detecting counterfeit or altered coins or bullion having a user interface including a display device 702 and an input device 704. The interface is configured to receive an indication of an expected composition of a sample from a user via the input device 704 and communicate the indication to the data processor (not shown). The data processor is configured receive measurement data from the detection system (not shown) based on the indication, and is configured to determine information regarding a composition of the sample based on the received measurement data. The user interface is configured to receive an indication of the information and communicate the indication of the information to the user via the display device 702 to distinguish valid coins and bullion from counterfeit or altered coins and bullion. While FIG. 7 discloses a specific embodiment of the invention, the figure and description thereof disclose general aspects of the invention which are not limited to this embodiment.

The system 700 may be a stand-alone system, and may include the elements shown in FIGS. 1 and 2. The display device 702 and input device 704 allow for quick selection of a metal or alloy type from a menu, which only takes a few seconds. Alternatively, an auto mode may be used that automatically suggests the sample alloy based on the metal, and thus requires no metal selection time. The display device 702 may show the metal type selected, and once the coin or bullion is placed on the surface 706, may have an easy-to-read and fast display of the metal reading. The measurement may take less than a second. The display device 702 and lamps 708 may tell the user the state of the detection device 700.

As shown in FIG. 7, the surface 706 on which the coin or bullion is placed may have a target 710 which may be used to position the coin or bullion under test. The target may be a circle or a rectangle, for example. The measurement may be started by a button, or may be run continuously so that the user may slide the sample over the measurement area. The presence of the sample may be automatically detected and a result may be displayed without user intervention. The device may be battery powered so that it is portable and can be used in the field. The device may be made to clamp or hold the coin or bullion under test, or the coin or bullion may be fed into the device by an automatic coin feeder so that large amounts of coin or bullion may be checked at a time without user intervention.

The data processor 208 may have a stored database of metals and their expected conductivities. The user may indicate an expected metal using the user interface 214, and the data processor 208 may look up in the values to expect from the detection system 206. The user interface 214 may show the metal or alloy selected by the user. The user may then place the sample on the target 710 which is positioned to allow the sensor system 202 to measure the sample.

During internal calibration or during mode changes, the display device 702 or lamps 708 in FIG. 7, or another indicator or external host computer may show the user when to place the sample, when the measurement is being made, and, if necessary, when to remove the sample. The display device 702 may be easy to read, and may not show numeric results because they may be more difficult to understand than more intuitive displays. However, numeric displays may be helpful in some cases. A more intuitive graphical display may be used that shows the user whether the measurement is within the expected range for a selected sample. A "gas gauge" or "bar graph" type display is easily interpreted and may clearly indicate if the result is within the expected range. This design makes the display device 702 fast and easy to read.

A routine may control the sensor excitation and reading of the voltages and currents. A routine may control the display device 702 and the input device 704, acting as a user interface. A routine may take the numeric result from the measurement and may convert it to an easy-to-read result in the display. A routine may manage the database or look-up table of metals and their characteristics, and may allow addition of new database metal or alloy values and possibly removal or modification of metals or alloys from the database or table. A routine may control power and battery use. A routine may allow connection of the device to a computer to allow reading of values by the computer and adding metals and alloys to the database or table. These routines may be executed by the data processor 208, or may be all or partially executed by a host computer connected through an interface. A USB port or other type of interface may connect the data processor 208 to the host computer. The host computer may be a PC, a cell phone, an internet connected device, or other computer.

The keys shown in the user interface may be ones that would typically be used on a stand-alone machine, although the same basic controls could be used on a host computer. The following discussion of the user interface pertains to both implementations, but by way of example the stand-alone buttons controls and display are used for explanation.

Figure 8:
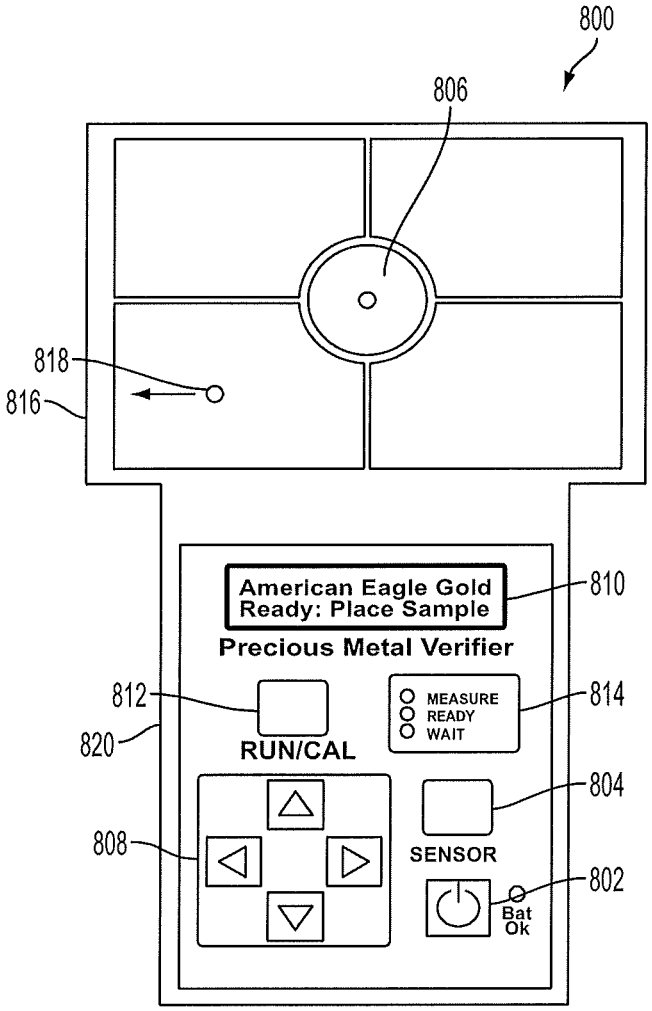
FIG. 8 depicts a user interface according to an embodiment of the invention.

The user interface according to an embodiment of the present invention is shown in FIG. 8. The user interface 800 may include a power on-off button 802 and a power lamp. There may be a button 804 that selects which sensor to use. Each press of the button may select a different sensor, possibly in a fixed sequence. The different sensors may have different diameters, and may be used to measure different sized samples. A lamp 806 may show which sensor is active. In the case of a pot core, the lamp 806 may be located in the center hole of the pot core so the light is in the middle of the target area where the user will place the sample. The detection device may include a port 816 for an external sensor, and the user interface 800 may include a lamp 818 that indicates when the external sensor is active.

The user may select the expected alloy of the sample. In an embodiment of the invention, this task may be performed using a navigation keypad 808. When the user pushes one of the navigation keys, the device may exit measurement mode and enter selection mode. The display 810 may show the current metal or alloy selected. The user may use the navigation keypad 808 to move through a list or a tree of metal selections. The metal selections may have categories based on the bullion metal, for example, there may be a gold category, a silver category, a platinum category, etc. Under each category there may be various alloys of that bullion metal. For example, under gold there may be pure gold, 91.7% crown gold, 90% gold, American eagle gold, etc. As the user navigates through the tree or list, the current selection may be shown in a line of the display 810.

Once the desired selection is shown in the display 810, the user may press the RUN/CAL button 812, and this may take the detection device out of selection mode and put it into run mode, where the measurement is made. The user may use a USB port 820 to communicate with an external computer or database.

The detection device may calibrate the sensor whenever a new sensor or a new metal is selected. The calibration process may be automatic and the user may not need to be concerned with it, but while calibration is occurring the device may indicate to the user not to place a sample on the target area. For example, a status lamp 814 indicting that the user "wait" may come on during calibration. Calibration only takes a second or so, and therefore the device may become ready almost immediately after selection of the desired sensor or metal.

If for some reason the user believes that the device needs to be calibrated, the user may press the RUN/CAL button 812 while the detection device is in run mode. This action may force a calibration of the sensor and electronics. This action may not normally be required, but if it has been a long time since calibration, or if the detection device has changed temperature, the system calibration measurements may change. Calibrating the detection device when it is not necessary is not harmful, in the sense that it takes very little time and does not negatively impact future readings. Accordingly, if the user is wondering if the device is correctly calibrated, they may perform a manual calibration to guarantee calibration. Further, if the result obtained by the detection device is unexpected (for example, a sample that appears to be valid reads out of range), then the user may calibrate the detection device as a matter of checking the result, and may re-run the sample.

The functions described above may be implemented on a computer display, pad display, or cell phone display, and may use a keypad, soft buttons on screen, or a touch screen to implement the button functions.

Figure 9:
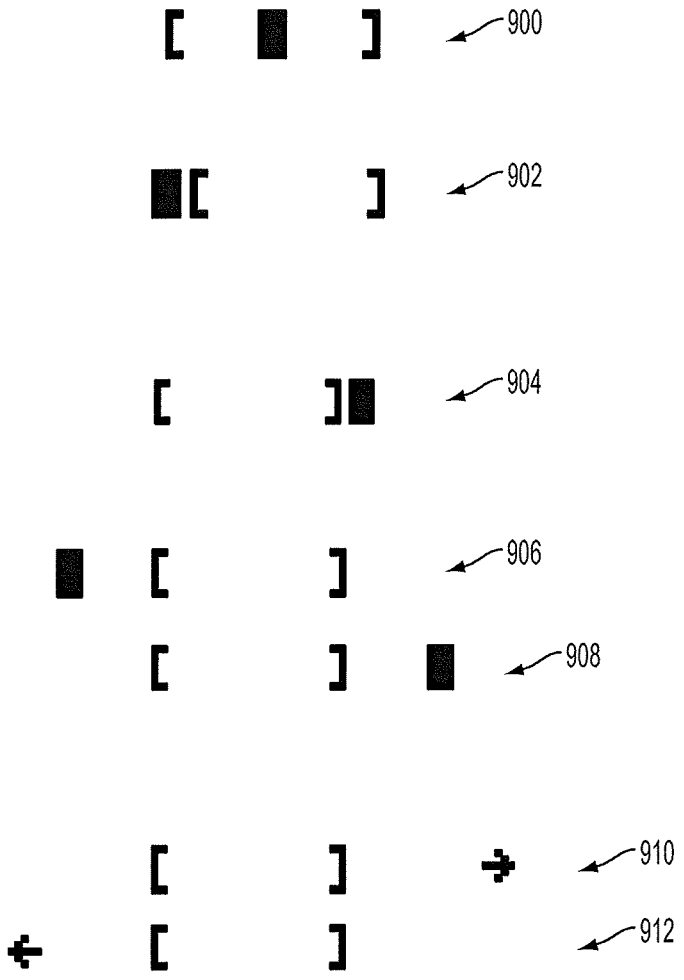
FIG. 9 shows how a validity result may be displayed according to an embodiment of the invention.

Because numbers may be confusing and hard to interpret for a user, a graphical display method may be desired. It may be important that the device not say "this is gold" or make a statement about what the sample metal or alloy is, because it may be the user's decision to make based on the device results in addition to other information, for example weight, appearance, specific gravity, or other measurement. A "gas gauge" or "target range" type of display may be used. There may be many ways to implement such a display, including things such as a needle and a scale, a bar graph, and other methods. FIG. 9 shows an example display on a stand-alone device according to an embodiment of the invention. The display may include brackets, wherein a box located between the brackets, as shown in display 900, indicates that the measured property of the sample falls within an acceptable range. The displays 902 and 904 show a bar just outside of the closed brackets, indicating that the sample's measurement is just outside the acceptable range. This may occur for a valid sample if the sample is very hot, has a deep embossment, is too thin or small, or is off center from the sensor. Further verification may be recommended. The displays 906 and 908 show a box that is farther outside of the brackets, indicating that it is unlikely that the sample is valid. The displays 910 and 912 show an arrow indicating that sample's measurements are very far from the expected values. In this case there is almost no chance that the sample is valid.

In an embodiment of the invention, the basic operation of the detection device may include the following. The user may turn on the detection device and may wait for the user interface to indicate that the device is ready. For example, the display may read "ready: place sample." The user may select a sensor using a "SENSOR" button. For example, the user may select an internal sensor or an external sensor. A lamp may illuminate showing the active sensor. The first line of the display may show the selected metal or alloy. To change the metal, the user may use the navigation keys to find the metal they wish to verify. Once the desired metal is shown in the display, the user may press the RUN/CAL button. When the display returns to "ready: place sample" mode, the instrument may be ready for use. The user may place the sample on the target, or if an external sensor is used, may place the external sensor in the proximity of the sample. The detection device may detect when a sample coin or bullion is close enough to the impedance component to obtain a reading, and as soon as the user has placed the sample in proximity of the impedance component, the data processor may indicate through the user interface that a measurement is being made. As the sample is being measured, the lower display line may continuously show the results. Once the measurement is completed, the display may show the final result for the sample. The measurement process can run continuously, allowing the user to quickly and conveniently move, flip, or change the sample at will.

If the user desires to measure another sample of the same alloy, they may simply remove the measured sample and place a new sample on the sensor. A second or so later the new sample measurement result will be shown on the display. If the user would like to change the metal or alloy, they may use the keypad or entry device to navigate through the database again, and the process may be repeated. If the user desires to measure a sample that is smaller or larger than the impedance component of the sensor is currently optimized for, the user may select a new sensor. The device might have more than one sensor in the device package, and external sensors containing smaller or larger impedance components may be plugged into the device. The user may use the keypad to select the sensor. The detection device may then calibrate the combination of hardware and sensor, and advise the user when it is ready to have the user place the sample. Once the detection device signals to the user to place the sample, the process is the same for the user as that described above.

In an embodiment of the invention, the data processor may have an internal Electrically Erasable Programmable Read-Only Memory (EEPROM) or flash memory to store the metals and alloys database. If the internal memory of the data processor is too small or inconvenient to use, an external EEPROM or other nonvolatile memory may be connected to the data processor to store database information. Typically only about 20 alloys are used for bullion and bullion coins. However, for numismatic coins 1,000 or more database entries may be needed. The database entries may include a metal name, a conductivity, a temperature coefficient, and a valid measurement range. However, for numismatic coins, each data base entry may include the coin name, year, mint, or other pertinent coin information. In the numismatic case the database may be on a coin-by-coin basis.

A database may be used that is external to the detection device. The user may connect to the database via the internet, and the database may be in a cloud or server. In this case, users may measure, upload, and download metal and alloy information using the database. In the case of numismatic coins, values for individual coins may be saved in the database, for example, if the coin has a high value and is unique. In the case of antique coins, values may be measured and shared by users, downloaded to their device, and used at coin shows or for their collection process. A website may facilitate users adding to the database, or using the database to evaluate samples.

The detection device may be mounted in a container which holds the measurement hardware, display, keypad, computer interface, and target for the sample. The container thickness separating the impedance component from the target for the sample may be thin (typically 0.5 mm) to position the sample as close to the sensor as possible.

In an embodiment of the invention, the impedance component may be external to the device. Alternatively, an external impedance component may be included in addition to one or more impedance components housed with the other hardware components of the detection device. This external impedance component may facilitate measurements on very large or small samples, and generally may make the measurement process easier. External impedance components such as sensor wands may plug into the detection device and allow for measurement of small samples. Although a smaller impedance component may be mounted inside the main instrument enclosure, there may be advantages to having a handheld sensor that includes the impedance component. When handling samples in cases, paper and plastic holders, and the like, it may be difficult to see where the measurement is being made on the sample because the holder may cover the target sensor area on the instrument. For large samples this may not be a problem, but as samples get smaller positioning the sample in the desired place may become more difficult, and the wand sensor may allow the user to see the sample area being measured. Also, with a wand-type sensor many samples in a folder or on a table can be measured without moving the sample.

Further, many plastic cases have ridges along the edge that prevent the face of the case from being scratched when the case is placed on a surface. These ridges prevent the coin or bullion sample from nearing the impedance component, and may impede the measurement process. Typically for small samples the distance from the sample to impedance component may be approximately 0.1 to 0.25 inches. With a wand, the ridge on the package may not prevent the sensor from coming into close proximity of the sample. The want thus allows measurements to be made through thicker packaging.

Figure 10:
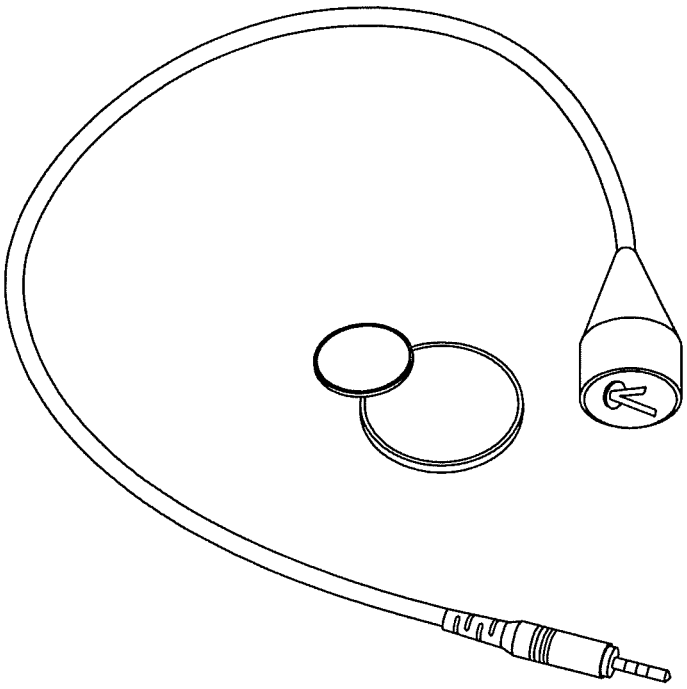
FIG. 10 show an external sensor according to an embodiment of the invention.
Figure 11:
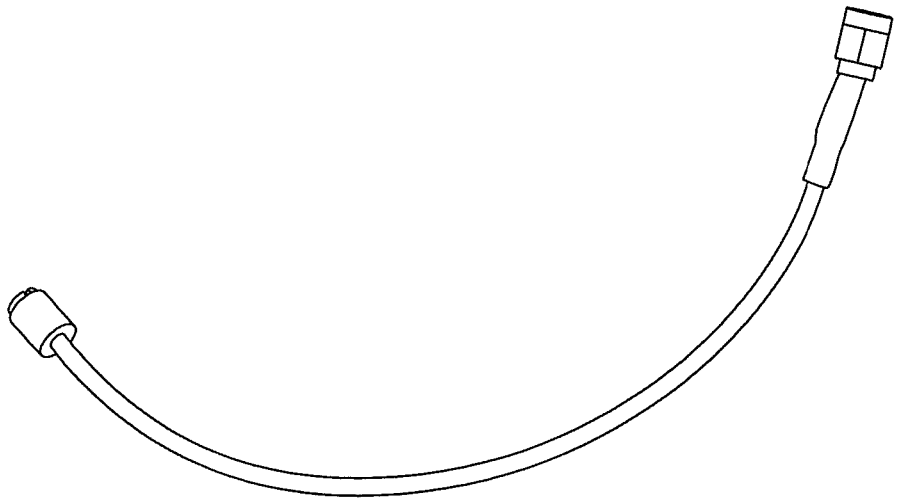
FIG. 11 shows an alternative external sensor according to an embodiment of the invention.
Figure 12:
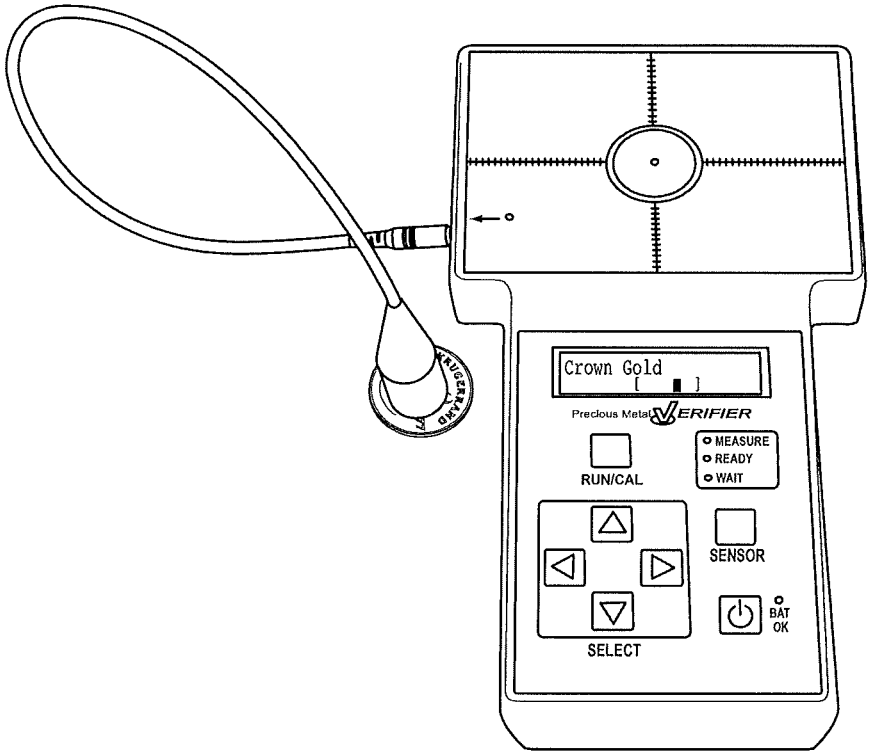
FIG. 12 illustrates how an external sensor may be positioned with respect to a sample.

FIG. 10 shows a picture of a typical wand sensor. The sensor shown may be used for 0.5 and 0.25 oz. samples. The face of the wand may be placed so that the coin or bullion surface is as close as possible and parallel to the sensor face. The phone plug may be inserted into the detection device. Much smaller wand sensors may also be made. For example, FIG. 11 shows an external sensor for measuring small samples down to 1 gram bars. The sensor is about 0.25 inches in diameter (7 mm), and consists of a 7 mm diameter pot core and wound coil. FIG. 12 shows the placement of an external sensor with respect to a sample. A lamp on the surface of the detection device is lit showing that the wand is in use, and the lamp on the main sensor is off, showing that it is not in use.

Smaller sensors may be used on thinner samples. One important aspect of the design and use of smaller sensors is that the frequency used to excite the sensor may be higher so that the electromagnetic waves may not penetrate all the way through the sample. The reason for this is that if the waves travel all the way through the sample the metal or alloy will give a reading that is incorrect. For small sensors frequencies typically range from 80 kHz to 1 MHz, with 80 kHz as a typical value. However, the small sensors may be used on large samples and at low frequencies as well. For example, samples that have an odd shape, like jewelry, may be measured as long as the sensor is small enough that the area of the sample that is being measured is fairly flat, and in this case a lower frequency might be used with a small sensor.

Typically a sensor wand may have an EEPROM or other digital memory that may be read by the main device. The EEPROM may identify the sensor type, tell the main device what frequencies to use for measurement, and send to the data processor of the main device any calibration information required to normalize the sensor readings. The EEPROM may be a 1-wire device such as the Maxim DS2431.

Figure 13A:
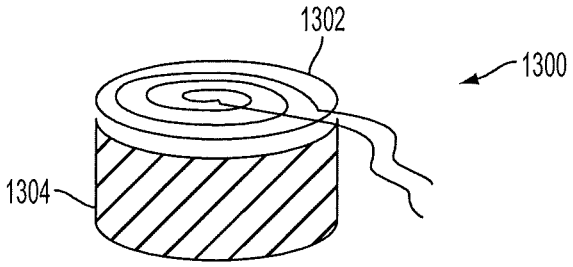
FIG. 13A is a schematic drawing of a sensor design.
Figure 13B:
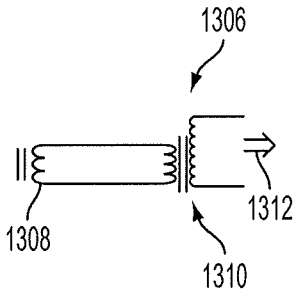
FIG. 13B is electrical circuit for connecting an external sensor to the detection device.

Most sensors include an impedance component that is a ferrite magnetic core with wound coils (typically a pot core). However, as the sensors get smaller, no standard cores are small enough to make the sensor. FIG. 13A is a schematic drawing of a sensor 1300 for very small samples. A flat coil 1302 may be made, typically on Kapton film, and may be attached to the end of a short rod 1304 of ferrite material. FIG. 13B shows an example electrical circuit 1306 that may be used in a very small sensor. With flat coils the number of turns on the coil 1308 is limited, so a matching transformer 1310 may be used to effectively increase the number of turns in the sensor as seen by the measurement circuit, indicated by arrow 1312.

The cable resistance, capacitance, and the stray inductance of the cable or matching transformers have no effect on the reading, because in the normal reading process, the sensor (and all of the stray reactances) are included in the calibration measurement, and are subtracted off of the subsequent values. Therefore, the cable length, matching transformers, etc. may be added as required by the physical measurement, and may be read without additional error by the same hardware described above.

Very large sensors may be used to measure very large samples such as 400 oz. London Good Delivery gold bars, standard 1,000 oz. silver bars, or other large bullion. Large bars may be from 5 to 1,000 oz. in weight, and typically have dimensions of approximately 3 inches in width and 2 inches in thickness. FIG. 14 shows dimensions for standard gold bars. The dimensions are given in millimeters. In order to measure through the bulk of a large bar, a large sensor may be provided that uses lower frequencies. To measure a 400 oz. gold bar through to at least half-thickness, the sensor may be more than 1.5 inches in diameter, and a frequency of approximately 100 Hz may be used. The same considerations may be applied to silver, platinum, and palladium bars.

Figure 15A:
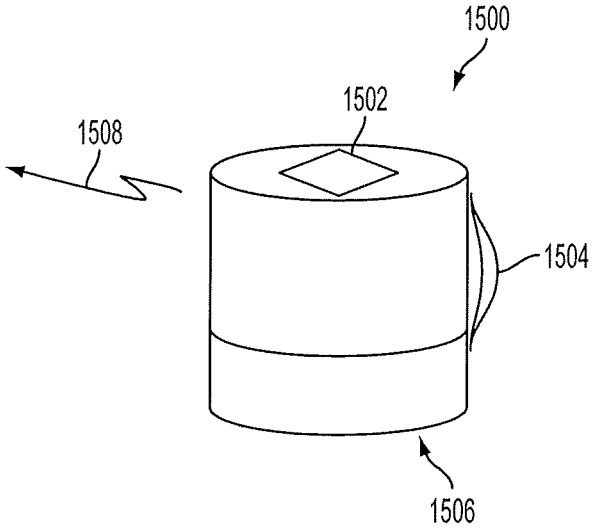
FIG. 15A shows an example sensor for large bars in accordance with an embodiment of the invention.
Figure 15B:
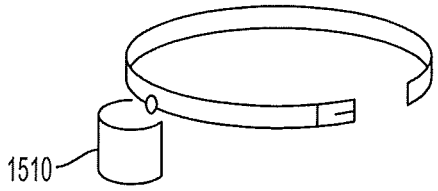
FIG. 15B shows a holster for an example sensor for large bars.

An example sensor for large bars in accordance with an embodiment of the invention is shown in FIG. 15A. In this case the size of the instrument is similar to the sensor size. The detection device 1500 may include a display 1502, a strap or handle 1504, and a sensor 1506. FIG. 15B shows how the detection device 1500 may be stored in a holster 1510 so that during the movement and exchange of bullion or coins a validity measurement could be made by the receiving agent on the spot. The detection device 1500 may be handy but easy to store out of the way when not in use, for example using a belt-attached holster. In another embodiment, a very large handheld wand may connect to a separate instrument.

According to another embodiment of the present invention, a large wand may be used to perform measurements on a large bullion bar. The advantage of a wand in this case is it is not necessary to move the bullion bar, which can be very heavy. Also, the wand can easily be moved around all sides of the bar.

The detection device 1500 may be connected to a data system that logs the results for various bars. Large bars usually have identifying numbers on them, and the result may be logged with the number so results records could easily be maintained. A radio-type or wireless network interface 1508 may be implemented, for example using Bluetooth, to send results data to a central logging computer or data repository. If anomalies are found in a bullion bar, it may be set aside for additional measurements. Since bullion is almost always gold, silver, platinum, or palladium (sometimes rhodium or a few other metals), the unit may auto detect the metal type, and no setting of the metal type may be required. Alternatively, the expected metal may be entered using the display 1502. Auto detection may be used in any of the embodiments described herein. However, auto detection may be more readily implemented when the number of possible matches for the sample is limited.

A measurement of a large bullion bar using the detection device 1500 may take approximately 2 seconds. The detection system in the detection device 1500 may be low pass filtered by a boxcar type filter (with finite impulse response) to lower the measurement time.

Other metals and alloys besides coins and bullion may be measured for process control and material validation. For example, some alloys used in aircraft must be exactly the correct alloy or the component may break or operation may be compromised. When such an aircraft material is about to be machined, or is about to be installed, a detection device may be used to measure the metal or alloy against the expected value, and validation of the correct material may be obtained.

Similarly, heat treatment of metals may be validated, since the readings may change for a given alloy depending on heat treatment, forming process, and mechanical history. Certain critical metal or alloy components, for example in rockets, may benefit from validation of the metal treatment.

Instead of comparing a sample to a database, the device may read out the conductivity reading for use in materials analysis. For example, antique coins may have conductivities that are affected by the metal purification process used and the alloy actually used. A user may use the raw conductivity measurement to establish the provenance, mine, smelter, or mint that made the coin as part of the investigation into the history of coins and bullion. The values read from the sample may be stored in the database under a name or title selected by the user, so that in the future if the user wishes to compare the database sample with a new sample (for example a coin), the user may merely find the name of the sample data they stored and recall it, and the instrument may then be ready to compare the old sample to the new sample. For example, some numismatic coins are very valuable, and are worth thousands or even millions of dollars. These specific coins may be read by the detection device and the value published so that any coin that purports to be that specific coin may be checked against the known reading on the detection device.

When pure metals are alloyed with other metals, conductivities virtually always drop and make detection of bogus material easier. Inspection of the sample, such as determining its size and weight, may also be important because it may be possible to make an alloy that would have the same conductivity as gold, for example, but not the expected weight as gold. The detection device may be paired with a weight scale and a size-measurement device so that the size, weight, and internal conductivity may be measured simultaneously. This combination of measurements may detect any combination of bogus materials used to imitate bullion.

Using the detection device described above, the thickness and diameter of a coin may be obtained. With this information the volume of the coin may be obtained, and in combination with the weight, the metal specific gravity may be measured. If the user knows the expected metal alloy of the sample, the specific gravity of the sample is also known and can be compared to the measured specific gravity. The combination of specific gravity and conductivity is a virtually unique signature for the metal sample, so a high degree of certainty of the validity of the sample may be obtained.

Figure 16:
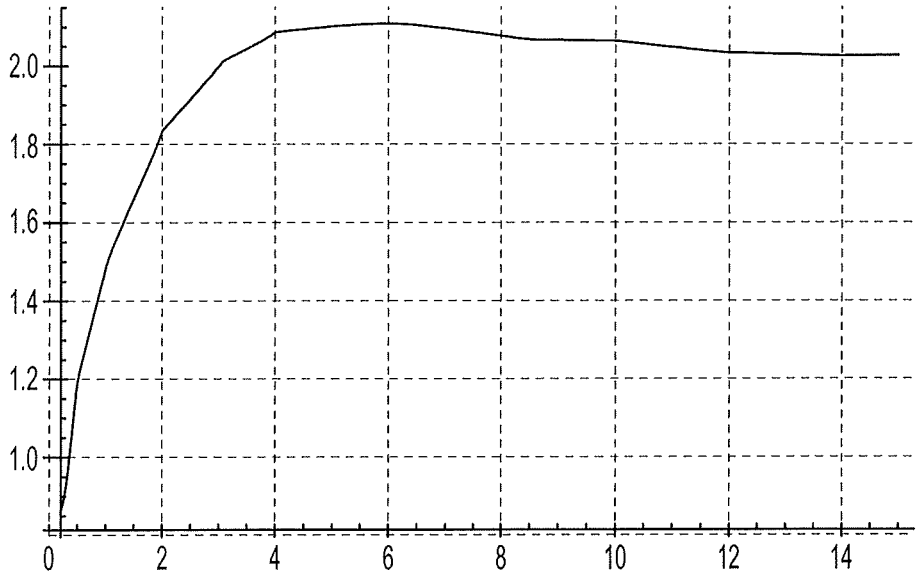
FIG. 16 shows measured Q vs. frequency for a 1/16 inch thick copper sample.
Figure 17:
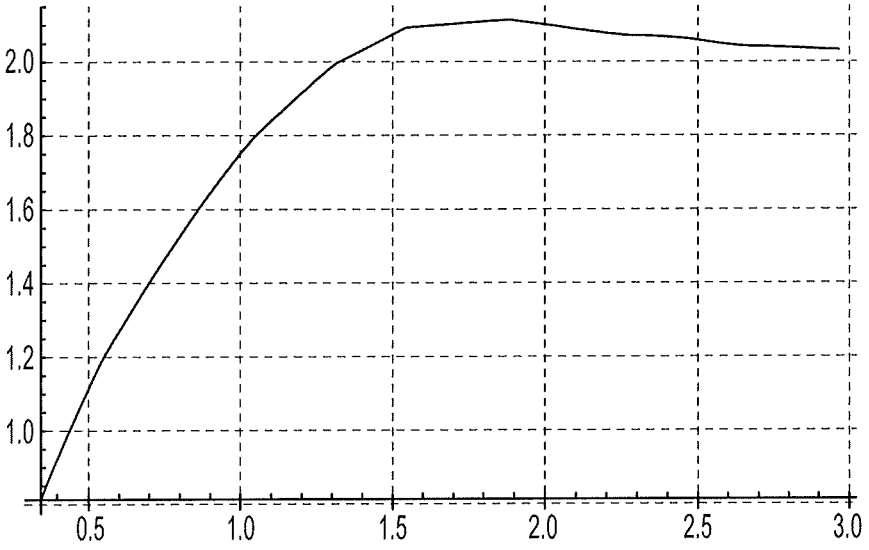
FIG. 17 shows measured Q vs. frequency for a 3/32 inch thick copper sample.

The thickness of the sample may be measured in a number of ways, including lowering the frequency of the sensor drive so that the electromagnetic waves penetrate the sample. The thickness may be calculated using the ratio of the Q value for this new lower frequency and the Q value for the higher, non-penetrating frequency that is used to determine the sample conductivity. FIG. 16 shows measured Q vs. frequency for a 1/16 inch thick copper sample. The horizontal axis is frequency in kHz and the vertical axis is Q normalized to 2 at frequencies high enough for no penetration of the sample. For high frequencies Q is approximately constant, while for lower frequencies Q begins to decrease significantly with decreasing frequency. It can be seen that the drop-off of Q occurs as the sample frequency approaches the skin depth of the material. The skin depth of the sample depends on the material and on the frequency, with skin depth increasing with decreasing frequency. For example, copper at 1 kHz the skin depth is 0.082 inches, just slightly larger than the sample thickness. It can be seen that the drop-off of Q occurs around 1 kHz, wherein the skin depth approaches the thickness of the sample. FIG. 17 shows a plot for a copper sample having a thickness of 3/32 inches. The drop in the Q reading for this sample occurs at a lower frequency, corresponding to a larger skin depth, and indicating that the sample is thicker than the 1/16 inch sample. By determining the frequency of the drop off or relative Q at a frequency low enough to penetrate the coin, the thickness of the coin can be measured.

Determining the thickness of a sample is a fairly simple matter of matching the curve to the measured curve normalized for skin depth, and since the skin depth of the sample is known (because the conductivity of the sample is known from the high frequency Q) the thickness may be obtained directly. The drop in the curve (for example, the 50% point) changes in frequency proportionally to 1/sqrt [thickness in skin depths]. A simplistic but workable way to obtain the thickness of the sample may be to find the frequency at which the normalized Q drops to 1/sqrt[2] of its peak value. The square root of this frequency is directly proportional to the thickness. Normalized Q is defined as Q measured by the detection device divided by the square root of the drive frequency. As long as the electromagnetic wave does not penetrate all the way through the sample in any significant manner (typically the thickness of the sample is greater than 2 or 3 skin depths of the sample), then this normalized Q is constant for a given material in the sample. Other methods may also be used to match the curve to a normalized curve, and obtain a better signal to noise ratio.

The measurement of sample thickness may be helpful in other ways. For example, if a particular coin was selected rather than its metal alloy, the thickness of the coin may be known and should read correctly if the coin is in fact the expected metal and coin. For example, if a bogus coin was made that had the same conductivity as crown gold and was made to look like a 1 oz. Kruggerrand (which is made of crown gold), then a valid conductivity and thickness, either alone or in combination with the weight and/or diameter, would assured the user that the coin is legitimate. It may be easy for a user to see that the diameter of a coin is correct, but the thickness may not be easy to measure because of stamping relief. If the diameter is correct, the thickness is correct, and the conductivity is correct, the coin is almost surely legitimate. In combination with the weight, faking a coin's conductivity and size would be virtually impossible.

Figure 18A:
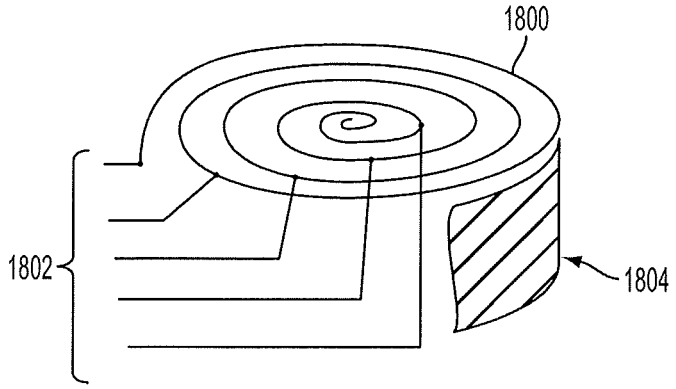
FIG. 18A shows a flat spiral coil with multiple taps along its length.
Figure 18B:
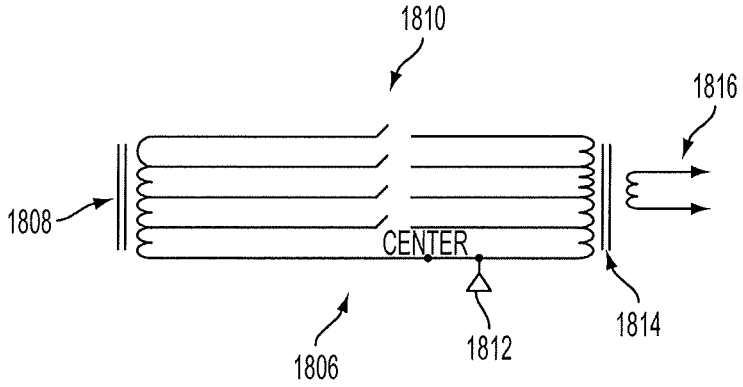
FIG. 18B shows an electrical circuit for a flat spiral coil with multiple taps along its length.

In an embodiment of the invention, with a minor modification of the impedance component, the diameter of the sample may be determined. As described above, the impedance component may be a flat spiral coil. FIG. 18A shows a flat spiral coil 1800 with multiple taps 1802 along its length. The flat spiral coil 1800 may have a magnetic material backing 1804, possibly made of ferrite. The multiple taps 1802 may be used to change the active diameter of the flat spiral coil 1800. The electrical circuit 1804 in FIG. 18B shows the tapped spiral coil 1806 with multiple electronic switches 1808 that allow for adjustment of the diameter of the coil, for example by closing one switch at a time. A drive signal 1810 may by connected to the center of the flat coil spiral 1806. A matching transformer 1812 may be used to maintain fairly constant impedance for the measuring circuit, indicated by the arrows 1814.

When a sample is placed on the sensor, various effective sensor diameters may be excited by closing the switches 1804 one at a time, and making the conventional Q measurement with the detection device. The Q values may be constant when normalized to the diameter of the spiral coil until the spiral is bigger than the sample. At that point the Q begins to drop, and the result obtained may be a direct function of the coin or sample diameter.

Figure 19A:
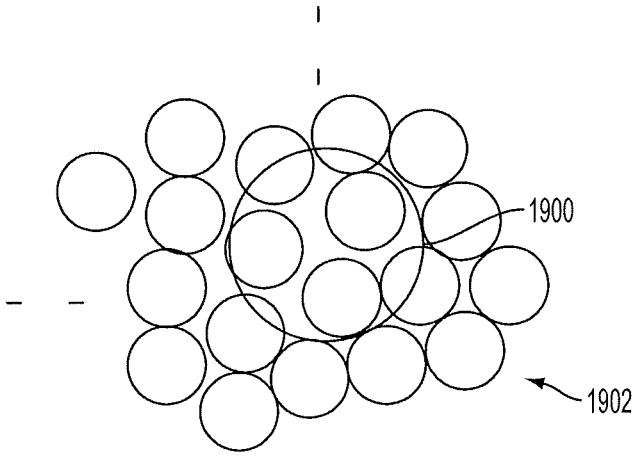
FIG. 19A illustrates how many small coils may be used in the place of a single large coil to perform a size or diameter measurement according to an embodiment of the invention.

In an embodiment of the invention, many small coils may be used in the place of a single large coil to perform a size or diameter measurement. The number of coils that are under or partially under the sample or coin may determine the size or diameter. FIG. 19A is a schematic drawing of this embodiment. The coin or sample 1900 may be placed anywhere on the array 1902 of small coils, and the same result may be obtained. Since the initial impedance of the sensor does not affect the reading of conductivity, coils that are not under the sample are unaffected by it and have no effect in the reading of the device.

Figure 19B:
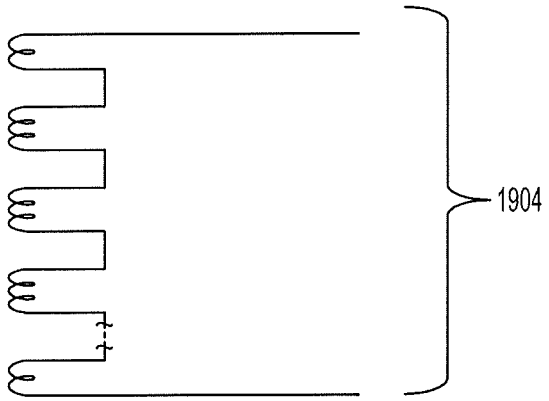
FIG. 19B shows a circuit diagram for an array of coils that may be used to perform size or diameter measurements.

The coil sensors may be connected in series, as shown FIG. 19B in the electrical circuit 1904, although this is not necessary to the measurement of the sample size. Each coil, or smaller blocks of coils, may be separately measured to obtain the size of the sample. The Q reading obtained from an array of small coils on a sample is effectively the same as with a single coil of the same size, so analysis of the results is fairly simple. What changes in this case is the coupling factor k, which varies with the size of the coin or sample.

Combining the measurement of the diameter and the thickness of a sample with the conductivity of the sample further guarantees the determination of the sample's validity. These methods can be combined with weight measurement methods to yield the specific gravity of the sample, which is weight/volume. Since the instrument has a metal selected, and the metal has a known specific gravity and conductivity, the combination of these measurements may be used to virtually guarantee the validity of the sample under test.

Figure 20:
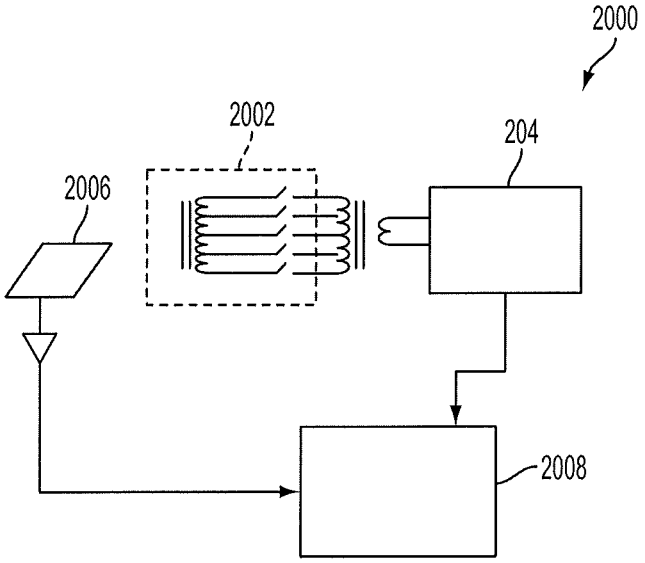
FIG. 20 is a schematic drawing of a measurement system having components to measure the thickness, diameter, conductivity, and weight of a sample.

FIG. 20 is a schematic drawing of a measurement system 2000 having components to measure the thickness, diameter, conductivity, and weight of a sample. The measurement system 2000 includes a standard verification circuit 2004 comprising a measurement circuit, an AC power supply, and a detection system. The measurement system 2000 also includes an impedance component 2002 that is electrically connected to the standard verification circuit 2004, and that may include multiple taps or an array of flat coils. The standard verification circuit 2004 may be in communication with a data processor 2008. The data processor 2008 may also be in communication with a weight measurement component 2006.

Figure 21:
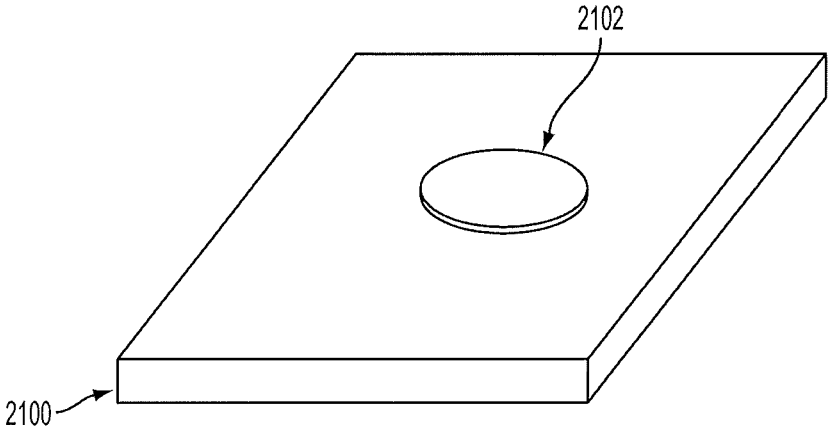
FIG. 21 illustrates how an impedance component may be embedded in the surface of a weight measurement component.

As illustrated in FIG. 21, the impedance component may be embedded in the surface 2100 of the weight measurement component, as long as the surface is made from a nonconductive material. A target may be embossed or printed on the surface 2100 so that the user knows where to place the coin or bullion sample 2102.

Figure 22:
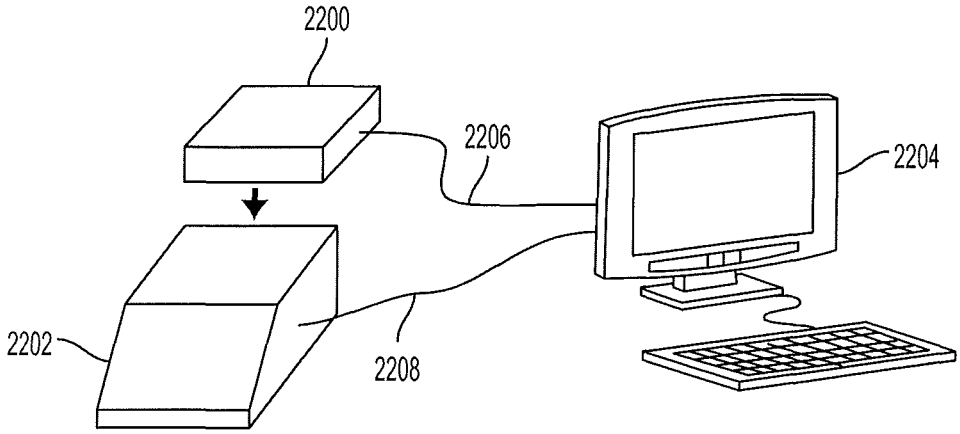
FIG. 22 illustrates how an off-the-shelf weight measurement component may be incorporated into the detection device.

Another embodiment of the invention may include a separate weight measurement component that has a digital or analog interface. The weight measurement component may be an off-the-shelf device, as shown in FIG. 22. The sensor or sensor array and detection hardware 2200 for the detection device may be placed on the weight measurement component 2202, and the weight measurement component 2202 may be tared. The sample or coin may then be placed on the top of the sensor and detection hardware 2200 so that the sensor and detection hardware 2200 may measure the conductivity and size of the sample while the weight measurement component 2202 measures the sample's weight. The sensor alone may only weigh 30 to 50 grams, so the weight errors may be small. The weight measurement component 2202 may be connected to the detection device's data processor 2204 or another processor that also obtained the size and conductivity information from the sensor and detection hardware 2200. This common processor 2204 may then calculate the specific gravity of the sample. For example, the common processor 2204 may be a PC with a USB connection 2206 to the sensor and detection hardware 2200, and a USB connection 2208 to the weight measurement component 2202.

In the embodiments of the invention described above, the coin or bullion to be checked may be placed in proximity to an impedance component and a display may show whether the material has the expected conductivity. The measurement may take about 1 second. It requires no chemistry and does not alter the sample. Once the calibration measurement has been made, only one frequency measurement of the sample may be required to determine the sample's validity. The process is inexpensive, fast, does not depend on coin size, shape, or stamping, and is virtually independent of the distance from the sample to the impedance component.

REFERENCES

[1] a) G. A. Snook, P. Kao, A. S. Best, *J. Power Sources* 2011, 196, 1-12; b) J. R. Miller, P. Simon, *Science* 2008, 321, 651-652; c) H. Li, Q. Zhao, W. Wang, H. Dong, D. Xu, G. Zou, H. Duan, D. Yu, *Nano Lett.* 2013, 13, 1271-1277.

[2] L. L. Zhang, X. S. Zhao, *Chem. Soc. Rev.* 2009, 38, 2520-2531.

The embodiments illustrated and discussed in this specification are intended only to teach those skilled in the art how to make and use the invention. In describing embodiments of the invention, specific terminology is employed for the sake of clarity. However, the invention is not intended to be limited to the specific terminology so selected. The above-described embodiments of the invention may be modified or varied, without departing from the invention, as appreciated by those skilled in the art in light of the above teachings. It is therefore to be understood that, within the scope of the claims and their equivalents, the invention may be practiced otherwise than as specifically described.

I claim:

1. A portable system for detecting counterfeit or altered coins or bullion, comprising:

a sensor system;

an alternating current (AC) power supply electrically connected to said sensor system;

a detection system electrically connected to said sensor system and said AC power supply;

a data processor configured to communicate with said detection system;

a user interface in communication with said data processor; and a portable container at least one of holding or containing therein at least said sensor system, said detection system, said data processor, and said user interface, wherein said user interface is configured to receive from a user an indication of an expected composition of said sample, wherein said portable container includes a target for determining a minimum size of said sample and for alignment of said sample by said user, wherein said sensor system comprises an impedance component and a measurement circuit, wherein said measurement circuit provides a measured value of at least one of voltage or current passing through said sensor system to said detection system, wherein said AC power supply provides at least one of an alternating current or voltage to said sensor system and to said detection system, wherein said detection system is configured to determine a calibration complex impedance based on said measured value of said at least one of voltage or current passing through said sensor system when no sample is in proximity of said impedance component, and based on at least one of said alternating current or voltage, respectively, provided by said power supply, wherein said detection system is configured to determine a sample complex impedance based on said measured value of said at least one of voltage or current passing through said sensor system when said sample is in proximity of said impedance component, and based on at least one of said alternating current or voltage, respectively, provided by said power supply, wherein said data processor is configured to receive said calibration complex impedance and said sample complex impedance from said detection system, wherein said data processor is configured to obtain an expected characteristic value from a look-up table based on said indication of said expected composition, and wherein said data processor is configured to provide information regarding a composition of said sample based on said calibration complex impedance and said sample complex impedance to distinguish valid coins and bullion from at least one of counterfeit or altered coins and bullion, wherein said information includes a comparison of said expected characteristic value with a measured characteristic value that is based on said calibration complex impedance and said sample complex impedance.

2. A portable system for detecting counterfeit or altered coins or bullion according to claim 1, wherein said data processor is further configured to determine a calibration inductance and a calibration resistance based on said calibration complex impedance, wherein said data processor is further configured to determine a sample inductance and a sample resistance based on said sample complex impedance, and wherein said data processor is further configured to determine said information regarding a composition of said sample based on said calibration inductance, said calibration resistance, said sample inductance, and said sample resistance.

3. A portable system for detecting counterfeit or altered coins or bullion according to claim 2, wherein said data processor is further configured to determine said information regarding a composition of said sample based on a difference between said calibration inductance and said calibration resistance and based on a difference between said sample inductance and said sample resistance.

4. A portable system for detecting counterfeit or altered coins or bullion according to claim 1, wherein said user interface is configured to display an indication of validity of said sample.

5. A portable system for detecting counterfeit or altered coins or bullion according to claim 1, wherein said impedance component includes a target for alignment of said sample.

6. A portable system for detecting counterfeit or altered coins or bullion according to claim 1, wherein said data processor is further configured to provide information regarding a composition of said sample based on information stored in said look-up table.

7. A portable system for detecting counterfeit or altered coins or bullion according to claim 1, wherein said detection system comprises a synchronous quadrature detector, wherein said synchronous quadrature detector is synchronous to said AC power supply.

8. A portable system for detecting counterfeit or altered coins or bullion according to claim 1, wherein said data processor is further configured to determine a displacement of said sample from said impedance component based on said calibration complex impedance and said sample complex impedance.

9. A portable system for detecting counterfeit or altered coins or bullion according to claim 8, wherein said data processor is further configured to provide information regarding a composition of said sample taking into account said displacement.

10. A portable system for detecting counterfeit or altered coins or bullion according to claim 1, wherein said impedance component comprises a plurality of flat spiral coils, wherein one of said plurality of flat spiral coils is used for said determination of said sample complex impedance.

11. A portable system for detecting counterfeit or altered coins or bullion according to claim 10, further including a lamp disposed on a surface of the portable container, said lamp corresponding to one of said plurality of flat spiral coils, wherein said lamp, when lit, indicates that said one of said plurality of flat spiral coils is in use.

12. A portable system for detecting counterfeit or altered coins or bullion according to claim 1, wherein said impedance component is a flat spiral coil, wherein said flat spiral coil has multiple taps along its length for changing an active diameter of said flat spiral coil.

13. A portable system for detecting counterfeit or altered coins or bullion according to claim 1, wherein said impedance component comprises an array of flat coils.

14. A portable system for detecting counterfeit or altered coins or bullion according to claim 1, further comprising an external impedance component external to said container.

15. A portable system for detecting counterfeit or altered coins or bullion according to claim 14, wherein said external impedance component is housed in a wand.

16. A portable system for detecting counterfeit or altered coins or bullion according to claim 14, further comprising a lamp indicating that said external impedance component is to be used for said determination of said sample complex impedance.

17. A portable system for detecting counterfeit or altered coins or bullion according to claim 1, wherein said impedance component comprises a plurality of coils, wherein each coil of said plurality of coils has a different diameter.

18. A portable system for detecting counterfeit or altered coins or bullion according to claim 1, wherein said information regarding a composition of said sample is a conductance of said sample.

19. A portable system for detecting counterfeit or altered coins or bullion according to claim 1, further comprising a weight measurement component in communication with said data processor.

20. A portable system for detecting counterfeit or altered coins or bullion according to claim 19, wherein said data processor is further configured to provide an indication of specific gravity of said sample based on said calibration complex impedance and said sample complex impedance and based on a weight measurement received from said weight measurement component.

21. A portable system for detecting counterfeit or altered coins or bullion according to claim 2, wherein said data processor is further configured to instruct said detection system to determine said sample complex impedance.

22. A portable system for detecting counterfeit or altered coins or bullion according to claim 21, wherein said instruction is based on a user input.

23. A portable system for detecting counterfeit or altered coins or bullion according to claim 21, wherein said detection system is configured to determine a system complex impedance based on said measured value of said at least one of voltage or current passing through said sensor system, and based on at least one of said alternating current or voltage, respectively, provided by said power supply, and wherein said instruction is based on said calibration complex impedance and said system complex impedance.

24. A portable system for detecting counterfeit or altered coins or bullion according to claim 23, wherein said data processor is further configured to determine a system inductance and a system resistance based on said system complex impedance, wherein said instruction is based on said calibration inductance, said calibration resistance, said system inductance, and said system resistance.

25. A portable system for detecting counterfeit or altered coins or bullion, comprising:

a detection system;

a data processor in communication with said detection system;

a user interface in communication with said data processor; and a portable container at least one of holding or containing therein at least said detection system, said data processor, and said user interface, wherein said user interface comprises an input device and a display device, wherein said user interface is configured to receive an indication of an expected composition of a sample from a user via said input device and communicate said indication to said data processor, wherein said portable container includes a target for determining a minimum size of said sample and for alignment of said sample by said user, wherein said data processor is configured to receive measurement data from said detection system based on said indication, wherein said data processor is configured to obtain an expected characteristic value from a look-up table based on said indication of said expected composition, wherein said data processor is further configured to determine information regarding a conductivity of said sample based on said received measurement data, wherein said information includes a comparison of said expected characteristic value with a measured characteristic value that is based on said measurement data received from said detection system; and wherein said user interface is configured to receive an indication of said information and communicate said indication of said information to said user via said display device to distinguish valid coins and bullion from at least one of counterfeit or altered coins and bullion.

26. A portable system for detecting counterfeit or altered coins or bullion according to claim 25, wherein said data processor is configured to determine a range of acceptable values for a characteristic value of said sample based on said received indication, wherein said determining is based on said look-up table.

27. A portable system for detecting counterfeit or altered coins or bullion according to claim 26, wherein said indication of said information communicated to said user includes said characteristic value and said range of acceptable values, and wherein said user interface is configured to display a non-numeric indication of said characteristic value with respect to said range of acceptable values to provide information regarding a composition of said sample.

28. A portable system for detecting counterfeit or altered coins or bullion according to claim 25, wherein said detection system comprises:

a sensor system;

an alternating current (AC) power supply electrically connected to said sensor system; and a detection component electrically connected to said sensor system and said AC power supply;

wherein said data processor is configured to communicate with said detection component;

wherein said sensor system comprises an impedance component and a measurement circuit, wherein said measurement circuit provides a measured value of at least one of voltage or current passing through said sensor system to said detection component, wherein said AC power supply provides at least one of an alternating current or voltage to said sensor system and to said detection component, wherein said detection component is configured to determine a calibration complex impedance based on said measured value of said at least one of voltage or current passing through said sensor system when no sample is in proximity of said impedance component, and based on at least one of said alternating current or voltage, respectively, provided by said power supply, wherein said detection component is configured to determine a sample complex impedance based on said measured value of said at least one of voltage or current passing through said sensor system when said sample is in proximity of said impedance component, and based on at least one of said alternating current or voltage, respectively, provided by said power supply, wherein said data processor is configured to receive said calibration complex impedance and said sample complex impedance from said detection component, and wherein said data processor is configured to determine said information regarding a conductance of said sample based on said calibration complex impedance and said sample complex impedance to distinguish valid coins and bullion from at least one of counterfeit or altered coins and bullion.

29. A portable system for detecting counterfeit or altered coins or bullion according to claim 28, wherein said data processor is further configured to determine a calibration inductance and a calibration resistance based on said calibration complex impedance, wherein said data processor is further configured to determine a sample inductance and a sample resistance based on said sample complex impedance, and wherein said data processor is further configured to determine said information regarding a conductance of said sample based on said calibration inductance, said calibration resistance, said sample inductance, and said sample resistance.

30. A portable system for detecting counterfeit or altered coins or bullion according to claim 29, wherein said data processor is further configured to determine said information regarding a conductance of said sample based on a difference between said calibration inductance and said calibration resistance and based on a difference between said sample inductance and said sample resistance.

31. A portable system for detecting counterfeit or altered coins or bullion, comprising:

a sensor system;

an alternating current (AC) power supply electrically connected to said sensor system;

a detection system electrically connected to said sensor system and said AC power supply;

a data processor configured to communicate with said detection system;

a user interface in communication with said data processor; and a portable housing at least one of holding or containing therein at least said detection system, said data processor, and said user interface, wherein said user interface is configured to receive from a user an indication of an expected composition of said sample, wherein said sensor system comprises an impedance component and a measurement circuit, wherein said impedance component is housed in a handheld wand external to said portable housing, wherein said measurement circuit provides a measured value of at least one of voltage or current passing through said sensor system to said detection system, wherein said AC power supply provides at least one of an alternating current or voltage to said sensor system and to said detection system, wherein said detection system is configured to determine a calibration complex impedance based on said measured value of said at least one of voltage or current passing through said sensor system when no sample is in proximity of said impedance component, and based on at least one of said alternating current or voltage, respectively, provided by said power supply, wherein said detection system is configured to determine a sample complex impedance based on said measured value of said at least one of voltage or current passing through said sensor system when said sample is in proximity of said impedance component, and based on at least one of said alternating current or voltage, respectively, provided by said power supply, wherein said data processor is configured to receive said calibration complex impedance and said sample complex impedance from said detection system, wherein said data processor is configured to obtain an expected characteristic value from a look-up table based on said indication of said expected composition, and wherein said data processor is configured to provide information regarding a composition of said sample based on said calibration complex impedance and said sample complex impedance to distinguish valid coins and bullion from at least one of counterfeit or altered coins and bullion, wherein said information includes a comparison of said expected characteristic value with a measured characteristic value that is based on said calibration complex impedance and said sample complex impedance.

* * * * *